US010407972B2

(12) United States Patent
Watson et al.

(10) Patent No.: US 10,407,972 B2
(45) Date of Patent: Sep. 10, 2019

(54) METHOD AND MECHANISM FOR CONTROLLING GRAVITATIONAL DISCHARGE OF MATERIAL FROM A RAILROAD HOPPER CAR

(71) Applicants: Richard A. Watson, Freedom, PA (US); Christopher C. Gaydos, Burlington, WI (US); Eric F. Wenzel, Lindenhurst, IL (US)

(72) Inventors: Richard A. Watson, Freedom, PA (US); Christopher C. Gaydos, Burlington, WI (US); Eric F. Wenzel, Lindenhurst, IL (US)

(73) Assignees: Miner Enterprises, Inc., Geneva, IL (US); Powerbrace Corporation, Kenosha, WI (US)

( * ) Notice: Subject to any disclaimer, the term of this patent is extended or adjusted under 35 U.S.C. 154(b) by 218 days.

(21) Appl. No.: 15/366,406

(22) Filed: Dec. 1, 2016

(65) Prior Publication Data

US 2018/0155977 A1 Jun. 7, 2018

(51) Int. Cl.

| | |
|---|---|
| ***E05F 17/00*** | (2006.01) |
| ***B61D 7/02*** | (2006.01) |
| ***E05F 15/00*** | (2015.01) |
| ***E06B 3/46*** | (2006.01) |
| ***E01B 27/02*** | (2006.01) |
| ***B61D 7/20*** | (2006.01) |
| ***B61D 7/26*** | (2006.01) |

(52) U.S. Cl.

CPC ..... *E05F 17/00* (2013.01); *B61D 7/02* (2013.01); *B61D 7/20* (2013.01); *B61D 7/26* (2013.01); *E01B 27/02* (2013.01); *E05F 15/00* (2013.01); *E06B 3/46* (2013.01); *E05F 2017/005* (2013.01); *E05Y 2201/716* (2013.01); *E05Y 2201/722* (2013.01); *E05Y 2900/51* (2013.01)

(58) Field of Classification Search

CPC ... B61D 7/00; B61D 7/02; B61D 7/06; B61D 7/14; B61D 7/16; B61D 7/20; B61D 7/24; B61D 7/30

See application file for complete search history.

(56) References Cited

U.S. PATENT DOCUMENTS

| | | | | |
|---|---|---|---|---|
| 722,299 | A | 3/1903 | Hansen | |
| 914,242 | A | 3/1909 | Campbell | |
| 1,122,918 | A | 12/1914 | Hart et al. | |
| 1,281,286 | A | 10/1918 | Campbell | |
| 4,628,825 | A * | 12/1986 | Taylor | B61D 7/28 105/253 |
| 6,227,124 | B1 | 5/2001 | Gaydos et al. | |
| 6,279,487 | B1 | 8/2001 | Gaydos et al. | |
| 7,814,842 | B2 | 10/2010 | Early | |

(Continued)

*Primary Examiner* — Robert J McCarry, Jr.

(74) *Attorney, Agent, or Firm* — Law Office of John W. Harbst

(57) ABSTRACT

A mechanism for conjointly operating a plurality of gate assemblies mounted on a hopper car having an elongated car body with sides and ends, and a bottom defining a discharge area comprised of a plurality of discharge openings. Each gate assembly includes a slide door arranged in operable association with one of the discharge openings. The mechanism operates the slide door on all the gates conjointly relative to each other. Methods for controlling the gravitational discharge of material from a hopper car are also disclosed.

32 Claims, 14 Drawing Sheets

(56) References Cited

U.S. PATENT DOCUMENTS

| | | | | |
|---|---|---|---|---|
| 7,819,067 | B2 * | 10/2010 | Early | B61D 7/20 105/282.1 |
| 8,485,110 | B2 | 7/2013 | Gaydos et al. | |

* cited by examiner

METHOD AND MECHANISM FOR CONTROLLING GRAVITATIONAL DISCHARGE OF MATERIAL FROM A RAILROAD HOPPER CAR

FIELD OF THE INVENTION DISCLOSURE

The present invention disclosure generally relates to railroad hopper cars and, more specifically, to a method and mechanism for controlling the gravitational discharge of material from a railroad hopper car.

BACKGROUND

One type of railroad freight car in use today is a hopper car wherein an elongated walled enclosure including one or more hoppers holds material or commodity therewithin. The walled enclosure is mounted on a mobile frame or undercarriage and defines a longitudinal axis for the railcar. When a top of such railcars is closed, as with covers and the like, the railcars can be used to transport corn and other granular materials. In those instances wherein the hopper has an open-top, such railcars are typically used to transport, aggregate, iron ore, coal and other granular commodities. With either design, railroad hopper cars offer an economical method of transporting large quantities of material between distant locations.

To facilitate the discharge of material from the walled enclosure, each hopper is typically configured with two or more longitudinally spaced chutes. Each chute is defined by a series of downwardly slanted walls which terminate toward a bottom of the walled enclosure. That is, and toward a lower end thereof, each chute defines an opening through which the material in the chute is gravitationally discharged upon arrival of the railcar at its intended destination. A gate assembly is arranged in operable association with each hopper opening. Typically, each gate assembly has a rigid frame defining a discharge outlet arranged in general registry with the opening at the bottom of each chute. Each gate assembly further includes a slide door or gate for controlling the discharge of material from the respective hopper. Typically, the door or gate of the gate assembly longitudinally slides on the frame anywhere between and to a closed position, wherein the slide door blocks or extends across the discharge outlet, and an open position, wherein the slide door is positioned relative to the discharge outlet so as to allow or permit material to gravitationally pass from the respective hopper.

With the gate assemblies typically arranged in longitudinally aligned relation relative to each other, the slide door on each gate sometimes inadvertently opens to some degree from its closed position. That is, as the cars are assembled into a train consist, they are purposefully bumped into each other. Moreover, during acceleration and abrupt stops of the train, longitudinal forces are placed on the slide doors which tend to urge them from the closed position toward the open position. Because the slide door movements may be slight, they often go unnoticed whereby allowing commodity to inadvertently escape from the hopper.

Accordingly, most gate assemblies are equipped with some form of lock assembly. The lock assembly inhibits the slide door of the gate assembly from inadvertently moving from the closed position. Various types of mechanisms are provided on the gate assembly and/or car for releasing the lock from a locked condition. Of course, providing a lock assembly in combination with the gate assembly to inhibit inadvertent movement of the slide door from the closed position along with a lock release mechanism adds to both the complexity and overall cost of the gate assembly.

To increase the carrying capacity of each hopper railcar, both the length and width of the walled enclosure have been optimized to the limits permitted by the Association of American Railroads (AAR). To provide sufficient distance for the sliding gates on adjacent assemblies to clear each other as they move toward their open positions, the openings at the bottom of the hopper are typically spaced longitudinally relative to each other. As mentioned, and between adjacent openings, there are angularly inclined or sloped sheets to enhance the gravitational flow of material in each hopper toward the opening. These Applicants recognized and appreciated, the relatively large areas beneath the sloped walls or surfaces of each hopper, however, constitutes wasted space. These Applicants furthermore recognized reducing the spacing between adjacent hopper openings could result in a reduction in the wasted space beneath the sloped walls or surfaces of each hopper. As such, the overall carrying capacity of each railroad hopper car can be advantageously increased without exceeding AAR specifications and the center of gravity of a loaded railcar can be advantageously lowered to enhance stability performance of the car.

Thus, there is a need and continuing desire for a railroad hopper car which allows for rapid discharge of materials from the walled enclosure while optimizing the material carrying capacity of the railcar and enhancing stability performance.

SUMMARY

In view of the above, and in accordance with one aspect of this invention disclosure, there is provided a a hopper railcar having a longitudinal axis. The railcar includes a hopper for receiving and holding materials and is mounted on a frame of the railcar. At least three individual gate assemblies are arranged on the hopper car. Two of the gate assemblies are longitudinally aligned to each other and disposed to one lateral side of the longitudinal axis of the railcar. Each gate assembly has a frame including two side frame members rigidly connected to two end frame members. The side frame members and end frame members of each gate assembly are each configured toward their upper end with a mounting flange to facilitate individualized mounting of each gate assembly to the hopper. The side frame members and end frame members of each gate assembly defining a discharge outlet arranged in material receiving relation relative to an opening defined by the hopper and partially defining the enlarged discharge area on the railcar. To reduce longitudinal spacing between adjacent openings defining the discharge area on the bottom of the railcar and thereby yielding an enhanced carrying capacity for the railcar, each individual gate assembly further includes a slide door movable on the frame in a direction extending generally normal to the longitudinal axis of the railcar. Each gate assembly furthermore includes a drive mechanism for moving the respective slide door anywhere between open and closed positions relative to the discharge outlet of the respective gate assembly. The drive mechanism for each gate assembly includes an elongated shaft which is rotatable about an axis extending generally parallel to the longitudinal axis of the railcar.

The railcar furthermore includes a drive apparatus for conjointly controlling the three individual gate assemblies anywhere between open and closed positions relative to a respective discharge opening of the respective gate assembly. The drive apparatus includes an operating shaft assembly rotatable about a fixed axis. The fixed axis of the operating shaft assembly extends generally normal to the longitudinal axis of the hopper railcar, with at least one end of the operating shaft assembly extending adjacent to one lateral side of the hopper railcar and such that rotation of the operating shaft assembly about the fixed axis thereof forcibly and conjointly moves the slide door of each gate assembly between positions as a function of the direction of rotation of the operating shaft assembly. The drive apparatus further includes a first drive shaft extending generally parallel to the longitudinal axis of the railcar. The first drive shaft is operably coupled to the drive mechanism associated with the two gate assemblies arranged to a common lateral side of the longitudinal axis of the railcar. A second drive shaft, extending generally parallel to the longitudinal axis of the railcar, is operably coupled to the drive mechanism for the third gate assembly mounted to a lateral side of the longitudinal axis of the hopper railcar opposite from at least one of the other two gate assemblies. A first force transfer mechanism operably connects the operating shaft assembly of the drive apparatus and the first drive shaft. A second force transfer mechanism operably connects the operating shaft assembly of the drive apparatus and the second drive shaft such that rotation of the operating shaft assembly forcibly and conjointly moves the slide door of each gate assembly between positions as a function of the direction of rotation of the operating shaft.

Preferably, each force transfer mechanism of the drive apparatus for conjointly controlling the multiple individual gate assemblies mounted to the hopper railcar includes a gear box having an input gear and an output gear arranged in intermeshing relationship relative to each other. In one form, the input gear and output gears of each gear box have a ratio of about 5:1 therebetween.

In a preferred embodiment, the operating shaft assembly of the drive apparatus for conjointly controlling the multiple individual gate assemblies mounted to a hopper railcar operably extends between the two longitudinally aligned gate assemblies. Preferably, the operating shaft assembly includes an elongated operating shaft, with at least one end of end of the operating shaft extending adjacent to at least one lateral side of the hopper railcar.

According to a second aspect of this invention disclosure, there is provided a railroad hopper car including an elongated car body defining a longitudinal axis and having a bottom defining an enlarged discharge area having at least three separate discharge openings. Two of the discharge openings are arranged in generally longitudinally aligned relation relative to each other and to one lateral side of the longitudinal axis of the car body with the third discharge opening being arranged to an opposed lateral side of the of the longitudinal axis of the car body. A gate assembly is arranged in operable combination with each discharge opening. Each gate assembly includes a slide door.

A mechanism is provided for simultaneously moving the sliding door of each gate assembly between a first position, wherein each slide door fully closes the respective discharge opening, and a second position, wherein each slide door is positioned to fully open the respective discharge opening to allow commodity in the car body to gravitationally escape therefrom or any position therebetween. In one embodiment, the mechanism is designed such that the sliding doors of those gate assemblies arranged on opposed lateral sides of the longitudinal axis the car body move in opposite lateral directions relative to each other when moving from the first position to the second position or any position therebetween. Such mechanism includes a single operating shaft assembly, operative in a rotational direction and about a fixed axis, for simultaneously moving all the sliding doors between positions.

Preferably, the drive mechanism for each gate assembly is comprised of a rack and pinion assembly including a pair of racks provided on each sliding door and a pair of pinion gears arranged in intermeshing relationship with the racks. The pinion gears are preferably arranged on a shaft supported by the frame of each gate assembly for rotational movement about a fixed axis.

Preferably, the single operating shaft assembly of the mechanism for simultaneously moving each of the sliding gates is operably connected to the sliding gates arranged to one lateral side of the longitudinal axis of the car body by a first force transfer mechanism. In a preferred form, the single operating shaft assembly of the mechanism for simultaneously moving each slide door of the gate assemblies disposed to one side of the longitudinal axis of the hopper car is operably connected to the sliding door arranged to an opposed lateral side of the longitudinal axis of the car body by a second force transfer mechanism such that rotation of the operating shaft assembly about the fixed axis thereof forcibly and conjointly moves all the slide doors between the first and second positions or any position therebetween as a function of the direction of rotation of the operating shaft.

In one form, each force transfer mechanism includes a gear box having an input gear and an output gear arranged in intermeshing relationship relative to each other. The input gear and output gears of each gear box preferably have a ratio of about 5:1 therebetween. In one embodiment, the single operating shaft assembly extends between the two longitudinally aligned gate assemblies. Preferably, at least one end of the single operating shaft assembly extends adjacent to at least one lateral side of the car body of the hopper car.

According to another aspect of this invention disclosure, there is provided a mechanism for conjointly operating at least three gate assemblies mounted on a hopper car having a longitudinal axis. The hopper car further includes an elongated car body having sides and ends, and a bottom defining an enlarged discharge area comprised of at least three discharge openings. At least two of the discharge openings are longitudinally aligned relative to each other and to one lateral side of the longitudinal axis of the car. Each gate assembly includes a slide door mounted in operable association with each discharge opening for controlling the gravitational discharge of material from the car body. Each gate assembly further includes a rotatable drive apparatus operably coupled to the respective gate.

The mechanism for conjointly operating the at least three gate assemblies mounted on the hopper car includes a single operating shaft assembly for conjointly moving the slide door of each gate assembly anywhere between a closed position and an open position. In one form, the slide door of at least one gate assembly disposed to one lateral side of the longitudinal axis of the hopper car moves in an opposite direction relative to the slide door of the gate assembly disposed to a second lateral side of the longitudinal axis of the hopper car as the slide doors each move from the closed position toward the open position.

Preferably, the rotatable drive apparatus of the two gate assemblies mounted to a common lateral side of the longitudinal axis of the hopper car are operably connected to each other by a shaft extending generally parallel to the longitudinal axis of the hopper car. In a preferred form, the single operating shaft assembly of the mechanism for conjointly moving the slide doors defines a rotational axis operably extending between the two gate assemblies mounted to the common lateral side of the longitudinal axis of the hopper car. In one form, the single operating shaft assembly of the mechanism for conjointly moving the gates includes an elongated operating shaft, with at least one end of end of the operating shaft extending adjacent to one lateral side of the hopper railcar.

In a preferred embodiment, the mechanism for conjointly operating the at least three gate assemblies mounted on the hopper car further includes a first force transfer mechanism for operably connecting the rotatable drive apparatus of the two gate assemblies mounted to a common lateral side of the longitudinal axis of the hopper car to the single operating shaft assembly. In a preferred embodiment, the mechanism for conjointly operating the at least three gate assemblies mounted on the hopper car further includes a second force transfer mechanism for operably connecting the rotatable drive apparatus of the gate assembly mounted to the opposed side of the longitudinal axis of the hopper car to the single operating shaft assembly.

The first force transfer mechanism preferably includes a gear box having an input gear and an output gear arranged in intermeshing relationship relative to each other. In one form, the input and output gears of the gear box of the first force transfer mechanism have a ratio of about 5:1 therebetween. The second force transfer mechanism also preferably includes a gear box having an input gear and an output gear arranged in intermeshing relationship relative to each other. In one form, the input gear and output gears of the gear box of the second force transfer mechanism also preferably have a ratio of about 5:1 therebetween.

In accordance with another aspect of this invention disclosure there is provided a hopper railcar which defines a longitudinal axis and has four individual gate assemblies mounted thereto. Each gate assembly is adapted to be operably associated with one of a series of openings forming part of a discharge area defined toward a bottom of the hopper railcar. First and second gate assemblies are generally longitudinally aligned relative to each other and disposed to one lateral side of the longitudinal axis of the hopper railcar. Third and fourth gate assemblies are generally longitudinally aligned relative to each other on a second gate assemblies and the second and fourth gate assemblies, respectively, are generally laterally aligned relative to each other. Each individual gate assembly has a frame including two side frame members rigidly joined to two end frame members. The side frame members and end frame members of each gate assembly are configured toward their upper end with a mounting flange to facilitate individualized mounting of the gate assembly to the railcar. The frame members of each individual gate assembly define a discharge outlet arranged in material receiving relation relative to one of the openings defined by a hopper on the railcar. Each individual gate assembly further includes a slide door mounted on the frame for movements in a direction extending generally normal to the longitudinal axis of the car. The first and second longitudinally aligned gate assemblies mounted to drive apparatus for moving the doors of the first and second gate assemblies anywhere between open and closed positions relative to the respective discharge opening of the respective gate assembly.

According to this aspect of the invention disclosure, there is provided a mechanism for conjointly controlling the four gate assemblies. Such mechanism includes an operating shaft assembly mounted for rotation about a fixed axis. The fixed axis of the operating shaft assembly extends generally normal to the longitudinal axis of the hopper railcar and has at least one end extending adjacent to one lateral side of the hopper railcar. According to this aspect of the invention disclosure, the mechanism for conjointly controlling the four individual gate assemblies further includes a drive shaft extending generally parallel to the longitudinal axis of the railcar and operably coupled to the drive apparatus of each of the first and second gate assemblies mounted to one lateral side of the longitudinal axis of the hopper railcar. Moreover, and according to this aspect of the invention disclosure, the mechanism for conjointly controlling the four gate assemblies also includes a force transfer mechanism operably connected between the operating shaft assembly and the drive shaft. According to this aspect of the invention disclosure, the mechanism for conjointly controlling the four gate assemblies has the slide doors of the third and fourth gate assemblies operably coupled to the slide doors of the first and second gates assemblies, respectively, such that rotation of the operating shaft assembly about the fixed axis thereof forcibly and conjointly moves the slide door of each gate assembly anywhere between and to the closed and open positions as a function of the direction of rotation of the operating shaft.

In one form, the force transfer mechanism of the mechanism for conjointly controlling the four gate assemblies includes a gear box having an input gear and an output gear arranged in intermeshing relationship relative to each other. Preferably, the input gear and output gears of each gear box have a ratio of about 5:1 therebetween.

In a preferred embodiment, the operating shaft assembly of the mechanism for conjointly controlling the four gate assemblies extends between the first and second generally longitudinally aligned gate assemblies. In one form, such operating shaft assembly includes an elongated operating shaft, with at least one end of end of the operating shaft extending adjacent to one lateral side of the hopper railcar.

According to another aspect of this invention disclosure, there is provided a mechanism for conjointly controlling first and second generally aligned gate assemblies adapted to be mounted to a hopper railcar having a longitudinal axis. Each gate assembly is adapted to be operably associated with first and second openings defined toward a bottom of the hopper railcar. Each gate assembly has a frame defining a discharge outlet and a door mounted on the respective frame of each gate assembly for generally horizontal sliding movements. A drive apparatus is arranged in operable combination with the first gate assembly for positively moving the slide door of the first gate assembly anywhere between and to a closed position and an open position relative to the discharge outlet of the first gate assembly. In one form, the drive apparatus includes an operating shaft assembly mounted on the frame of the first gate assembly for rotation about a fixed axis and a mechanism for converting rotation of the operating shaft assembly into linear movements of the slide door of the first agate assembly.

According to this aspect of the invention disclosure, the mechanism for conjointly controlling the first and second generally aligned gate assemblies further includes an apparatus for operably interconnecting the slide doors of the first and second gate assemblies. As such, linear movements of the door of the first gate assembly is effectively transferred to the door of the second gate assembly and used to linearly and conjointly move the door of the second gate assembly anywhere between and to closed and open positions.

In one form, the fixed axis of the operating shaft assembly of the drive apparatus extends generally parallel with the longitudinal axis of the hopper railcar. The operating shaft assembly of the drive apparatus preferably arranged in operable combination with the first gate assembly includes an elongated operating shaft mounted for rotation about the fixed axis of the operating shaft assembly. In one form, the drive apparatus further includes a rack and pinion assembly.

The apparatus for operably interconnecting the slide door of the first gate assembly with the slide door of the second gate assembly preferably includes a series of spaced connectors extending between the slide doors of the first and second gate assemblies. Spacing between the connectors permits substantially uninterrupted passage of material thereover. In this embodiment, the connectors of the apparatus for operably interconnecting the slide doors of the first and second gate assemblies are arranged in generally parallel relation relative to the longitudinal axis of the hopper railcar. In operation, the apparatus for operably interconnecting the slide door of the first gate assembly with the slide door of the second gate assembly functions to operably push the slide door of the second gate assembly from the closed position toward the open position in response to movement of the slide door of the first gate assembly from the closed toward position toward the open position.

According to another aspect of this invention disclosure, there is provided a method for controlling the gravitational discharge of commodity from a railcar hopper car having an elongated car body and an elongated axis. The method includes the steps of: configuring a bottom of the elongated car body with a discharge area including at least three discharge openings, with two of the openings being arranged to one lateral side of the longitudinal axis of the car and the other on the opposite side of the longitudinal axis of the car. Another step involves: mounting a gate assembly individually and in general registry with each discharge opening to control the gravitational discharge of commodity from the car. Each gate assembly includes two side frame members rigidly interconnected to two end frame members. The side frame members and end frame members of each gate assembly are configured toward their upper end with a mounting flange to facilitate individualized mounting of each gate assembly to the elongated body of the railcar. Then end frame members and side frame members of each gate assembly defining therebetween a discharge outlet arranged in material receiving relation relative to one of the discharge openings defined by the bottom of the elongated body on the railcar. With each gate assembly further including a slide door mounted between the side frame members and end frame members of each gate assembly and movable anywhere between and to closed and open position relative to the respective discharge outlet in a direction extending generally normal to the elongated axis of the hopper car. Each gate assembly further includes a rotatable drive operably coupled to the respective slide door for moving the respective slide door anywhere between and to closed and open positions. Another step involves: using a single operating shaft assembly having a fixed axis of rotation to move the slide door of each gate assembly conjointly relative to each other between the closed and open positions so as to facilitate discharge of materials from the railcar through the discharge area.

Preferably, the method for controlling discharge of commodity from the railcar hopper car includes the further step of: arranging the rotational axis of the single operating shaft assembly such that the rotational axis operably extends between the two gate assemblies mounted to the common lateral side of the longitudinal axis of the hopper car. In one form, the method for controlling discharge of commodity from the railcar hopper car preferably includes the further step of: connecting the rotatable drives of the two gate assemblies mounted to a common lateral side of the longitudinal axis of the hopper car with a shaft extending generally parallel to the longitudinal axis of the hopper car. In one embodiment, the method for controlling discharge of commodity from the railcar hopper car includes the further step of: providing a first force transfer mechanism for operably connecting the shaft used to connect the rotatable drives of the two gate assemblies mounted to a common lateral side of car to the single operating shaft assembly.

In one embodiment, the method for controlling discharge of commodity from the railcar hopper car includes the further step of: providing a second force transfer mechanism for operably connecting the shaft used to connect the rotatable drive of the gate assembly mounted to an opposite lateral side of car to the single operating shaft assembly.

According to another aspect of this invention disclosure, there is provided a method for controlling the gravitational discharge of commodity from a railroad hopper car having an elongated car body defining an elongated axis The elongated car body has opposed lateral sides along with a bottom defining first and second aligned discharge openings. According to this aspect of the invention disclosure the method comprises the steps of: arranging a first gate assembly in general registry with the first discharge opening to control the gravitational discharge of commodity from the railcar. The first gate assembly includes a slide door movable along a generally horizontal and linear path of travel. The first gate assembly also includes a drive apparatus for positively moving the slide door of the first gate assembly anywhere between closed and open positions relative to the first discharge opening. The drive apparatus of the first gate assembly includes a rotatable operating shaft assembly and a mechanism for converting rotation of the operating shaft assembly into linear movements of the slide door of the first agate assembly.

According to this aspect of the invention disclosure, the method also includes the step of: arranging a second gate assembly in general registry with the second discharge opening to further control the gravitational discharge of commodity from the railcar. The second gate assembly includes a slide door movable along a generally horizontal and linear path of travel. The method also includes the step of: interconnecting the slide door of the first gate assembly with the slide door of the second gate assembly such that linear movements of the door of the first gate assembly anywhere between the closed and open positions are effectively transferred to the door of the second gate assembly and used to linearly and conjointly move the door of the second gate assembly.

Preferably, the method according to this aspect of the invention disclosure furthermore involves the step of: arranging the first and second gate assemblies in generally aligned relation longitudinally relative to each other. According to this aspect of the invention disclosure, the mechanism for converting rotation of the operating shaft assembly into linear movements of the slide door of the first agate assembly preferably includes a rack and pinion assembly. In a preferred form, the first and second gate assemblies are interconnected with connectors extending between and secured to each slide door. Each connector is preferably configured as to not substantially interfere with the gravitational flow of material from the first and second discharge openings.

According to another aspect of this invention disclosure, there is provided a method for controlling the gravitational discharge of commodity from a railroad hopper car. The railroad hopper car has an elongated car body having opposed lateral sides and defining an elongated axis, with the elongated body having opposed lateral sides. The railcar also has a bottom defining first and second discharge openings disposed to opposed lateral sides of the elongated axis of the railcar. According to this aspect of the invention disclosure, the method comprises the steps of: arranging a first gate assembly in general registry with the first discharge opening to control the gravitational discharge of commodity from the elongated car body. The first gate assembly includes a slide door movable along a generally horizontal and linear path of travel.

The first gate assembly further includes a drive apparatus for positively moving the slide door of the first gate assembly anywhere between the closed position and the open position relative to the first discharge opening. According to this aspect of the invention disclosure, the drive apparatus preferably includes a rotatable operating shaft assembly, and a mechanism for converting rotation of the operating shaft assembly into linear movements of the slide door of the first agate assembly.

According to this aspect of the invention disclosure, the methodology includes the further step of: arranging a second gate assembly in general registry with the second discharge opening to further control the gravitational discharge of commodity from the railcar. According to this aspect of the invention disclosure, the second gate assembly includes a slide door movable along a generally horizontal and linear path of travel. According to this aspect of the invention disclosure, the methodology includes the further step of: interconnecting the slide door of the first gate assembly with the slide door of the second gate assembly such that linear movements of the door of the first gate assembly anywhere between the closed and open positions are effectively transferred to the door of the second gate assembly and used to linearly and conjointly move the door of the second gate assembly with the door of the first gate assembly.

Preferably, the method according to this aspect of the invention disclosure furthermore involves the step of: arranging the first and second gate assemblies such that the slide door of each gate assembly moves in a direction extending generally normal to the longitudinal axis of the railroad hopper car. According to this aspect of the invention disclosure, the step of arranging the first and second gate assemblies involves generally aligning the first and second gate assemblies laterally relative to each other. Preferably, the mechanism for converting rotation of the operating shaft assembly into linear movements of the slide door of the first agate assembly includes a rack and pinion assembly.

The preferred methodology according to this aspect of the invention disclosure includes the further step of: using a single operating shaft assembly having a fixed axis of rotation to move the slide doors of the first and second gate assemblies conjointly relative to each other between their closed and open positions. According to this aspect of the invention disclosure, the slide doors of the first and second gate assemblies are interconnected with connectors extending between and secured to each slide door. The connectors are preferably configured as to not interfere with the gravitational flow of material from the first and second discharge openings.

In this embodiment of the invention disclosure, the bottom of the elongated body on the railcar further defines third and fourth discharge openings disposed to opposed lateral sides of the elongated axis of the railroad hopper car. According to this aspect, the methodology also involves: providing third and fourth gate in generally laterally aligned relation relative to each other. According to this aspect of the invention disclosure, the methodology further includes the step of: arranging the third gate assembly in general registry with the third discharge opening on the car to control the gravitational discharge of commodity from the railcar, with the third gate assembly including a slide door movable along a generally horizontal and linear path of travel and a drive apparatus for positively moving the slide door of the third gate assembly anywhere between and to the closed position and the open position relative to the third discharge opening. According to this aspect, the drive apparatus for the third gate assembly includes a rotatable operating shaft assembly, and a mechanism for converting rotation of the operating shaft assembly into linear movements of the slide door of the third gate assembly.

According to this aspect, the methodology also involves: arranging the fourth gate assembly in general registry with the fourth discharge opening on the car to further control the gravitational discharge of commodity from the railcar. According to this aspect, the fourth gate assembly includes a slide door movable along a generally horizontal and linear path of travel anywhere between a closed and an open positions relative to the fourth discharge opening. Another step involved with this aspect of the invention disclosure includes: interconnecting the slide door of the third gate assembly with the slide door of the fourth gate assembly such that linear movements of the slide door of third gate assembly are effectively transferred to the slide door of the fourth gate assembly and used to linearly and conjointly move the slide door of the fourth gate assembly with the slide door of the third gate assembly between closed and open positions.

Preferably, the method according to this aspect of the invention disclosure furthermore involves the steps of: arranging the third gate assembly in general longitudinal alignment with the first gate assembly; and, arranging the fourth gate assembly in general longitudinal alignment with the second gate assembly.

The preferred methodology according to this aspect of the invention disclosure includes the further step of: using a single operating shaft assembly with a fixed rotational axis to move the slide doors of the first, second, third and fourth gate assemblies conjointly relative to each other between their closed and open positions. According to this aspect of the invention disclosure, the methodology further includes the step of: arranging the axis of the single operating shaft assembly such that the axis operably extends between the first and third gate assemblies mounted to the common lateral side of the longitudinal axis of the hopper car.

Preferably, and according to this aspect of the invention disclosure, the methodology further includes the step of: connecting the drive apparatus of the first and third gate assemblies, mounted to a common lateral side of the longitudinal axis of the hopper car, with a shaft extending generally parallel to the axis of the hopper car. Preferably, and according to this aspect of the invention disclosure, the methodology further includes the step of: providing a force transfer mechanism for operably connecting the drive apparatus of the first and third gate assemblies to the single operating shaft assembly used to conjointly move the slide doors of the gate assemblies between positions.

DETAILED DESCRIPTION

Figure 1:
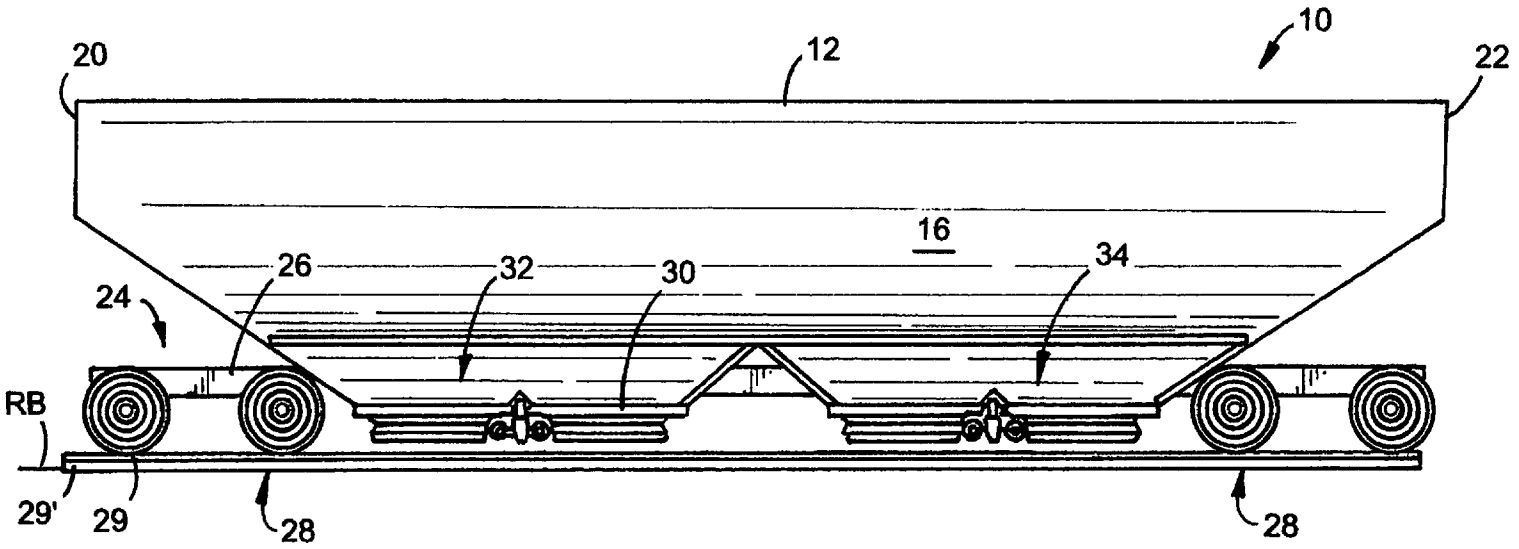
FIG. 1 is a side elevational view of a railroad hopper car embodying principals and teachings of this invention disclosure.

While this invention disclosure is susceptible of embodiment in multiple forms, there is shown in the drawings and will hereinafter be described preferred embodiments, with the understanding the present disclosure is to be considered as setting forth exemplifications of the disclosure which are not intended to limit the disclosure to the specific embodiments illustrated and described.

Figure 2:
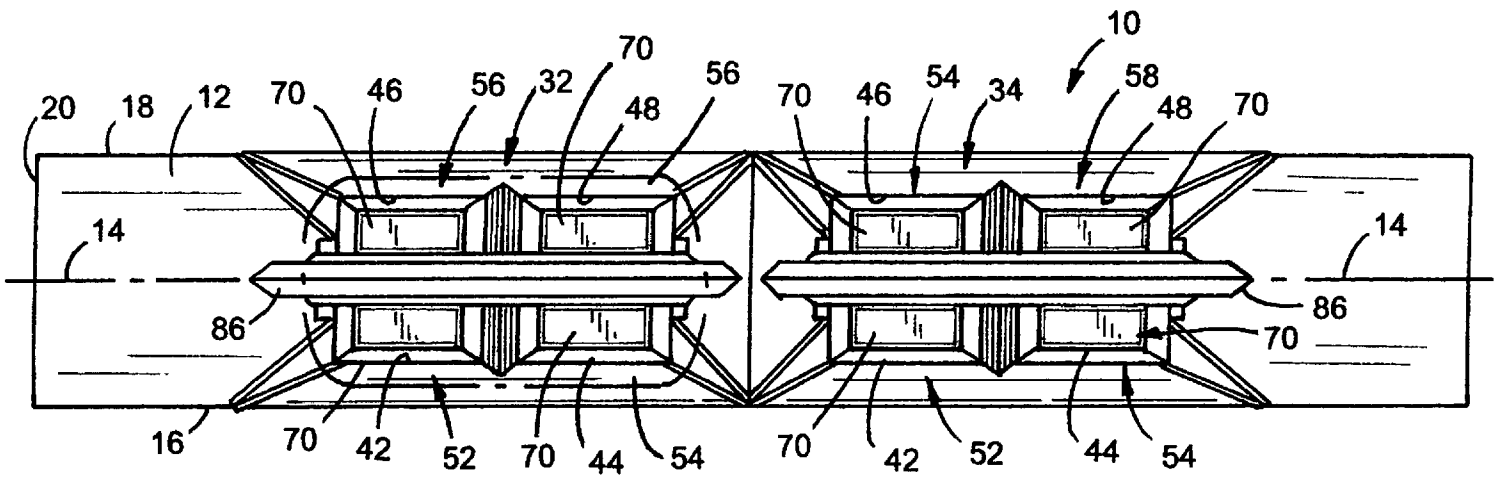
FIG. 2 is a top plan view of the hopper car illustrated in FIG. 1.

Referring now to the drawings, wherein like reference numerals indicate like parts throughout the several views, there is shown in FIG. 1 a railroad hopper car generally designated by reference numeral 10. Car 10 includes a walled enclosure or hopper 12 wherein materials or commodity are stored and shipped. As shown in FIG. 2, car 10 defines a longitudinal axis 14. The hopper or enclosure 12 has a generally rectangular configuration, in plan, toward an upper end thereof and includes upstanding rigid side walls 16 and 18 rigidly joined to upstanding end walls 20 and 22. Returning to FIG. 1, the walled enclosure 12 is carried on a mobile frame 24 which, in the illustrated embodiment includes an elongated center sill 26 extending parallel to the axis 14 and substantially the length of car 10. It will be appreciated, however, the teachings and principals of this invention disclosure equally apply to railcars which have stub sills at opposed ends with no center sill extending the length of the car. Opposed ends of the walled enclosure or hopper 12 are supported in a well known manner by trucks 28 shown pictorially in FIG. 1. As shown in FIG. 1, wheels of each truck 28 engage and roll over a pair of laterally spaced rails 29, 29' on a road bed RB.

In the embodiment illustrated for exemplary purposes in FIG. 1, a bottom 30 of the walled enclosure or hopper 12 is provided with at least two longitudinally spaced discharge areas 32 and 34 from whence material in the hopper 12 is gravitationally discharged. It will be appreciated, however, the bottom 30 of the walled enclosure 12 can be provided with more than two discharge areas without detracting or departing from the novel spirit and broad scope of this invention disclosure. In the illustrated embodiment, the discharge areas 32 and 34 are substantially identical relative to each other and, thus, only discharge area 32 will be discussed in detail.

In the embodiment illustrated in FIG. 2, each discharge area 32 and 34 at the bottom of the of the hopper 12 includes a plurality of discharge openings for allowing or permitting material in the hopper 12 to be rapidly and gravitationally discharged in a controlled manner therefrom. In the illustrated embodiment, each discharge area 32, 34 at the bottom of hopper 12 includes four discharge openings 42, 44, 46 and 48 arranged in a side-by-side pattern relative to each other to enhance the cubic capacity of the hopper 12 and improve stability of the car by lowering the center of gravity of the car.

Figure 3:
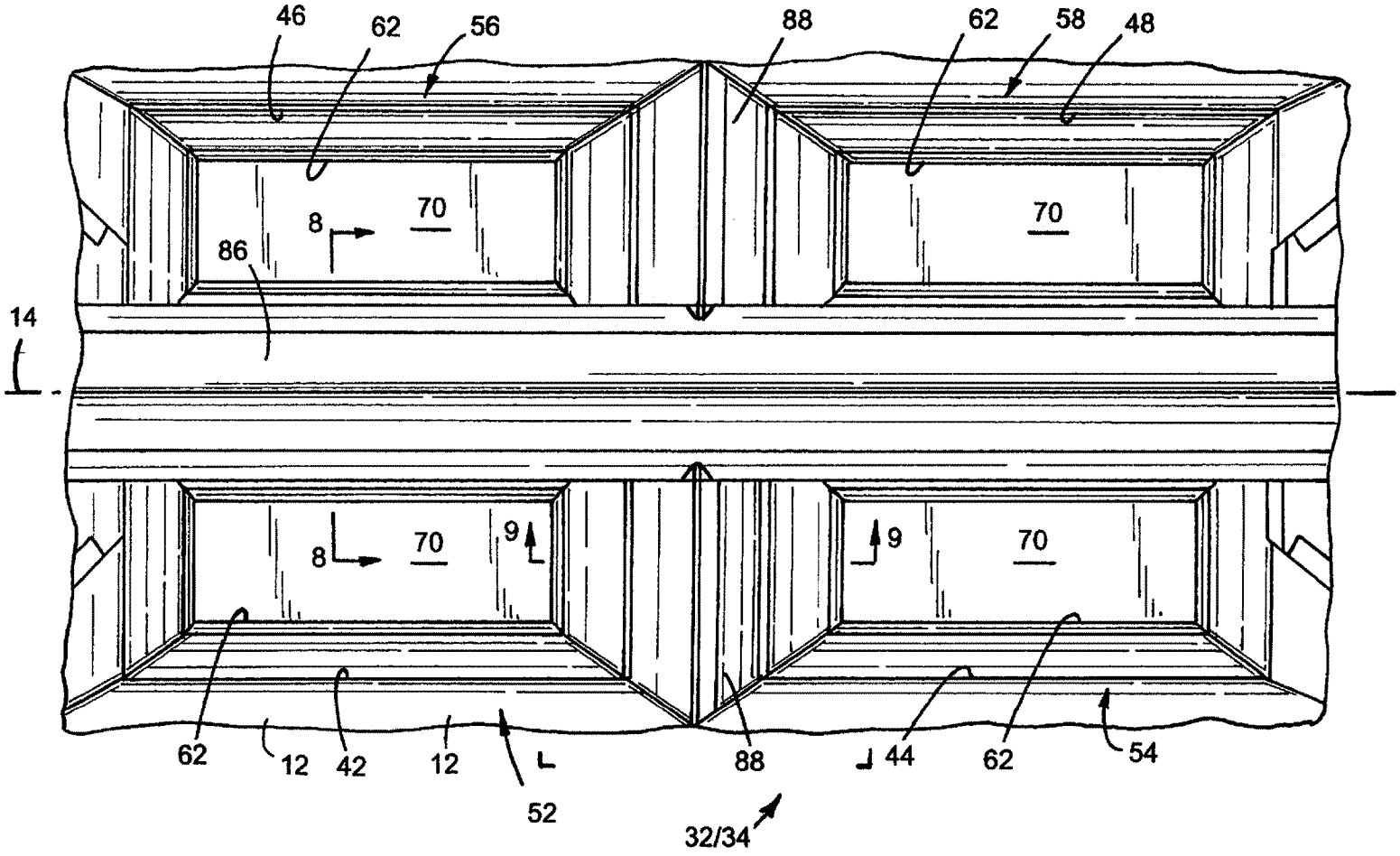
FIG. 3 is an enlarged top plan elevation view of the area encircled in phantom lines in FIG. 2.

In the embodiment illustrated by way of example in FIGS. 2 and 3, the first pair of discharge openings 42, 44 and the second pair of 46, 48 are arranged and disposed to opposed lateral sides of the longitudinal axis 14 of the car 10. In the illustrated embodiment, the first pair of openings 42, 44 are preferably disposed in substantially aligned relation longitudinally relative to each other. In the illustrated embodiment, the other pair of openings 46, 48 are also preferably disposed in substantially aligned relation longitudinally relative to each other. Whereas, the discharge openings 42, 46, arranged and disposed to opposite lateral sides of the longitudinal axis 14 of the car 10, are preferably in substantially aligned relation laterally relative to each other. Moreover, the discharge openings 44, 48, arranged and disposed to opposite lateral sides of the longitudinal axis 14 of the car 10, are preferably in substantially aligned relation laterally relative to each other.

It should be appreciated, however, the number of discharge openings comprising each discharge area can be lesser or greater than four without detracting or departing from the novel spirit and scope of this invention disclosure. For example, and given an otherwise configured discharge area, the number of discharge openings could equal greater than four, preferably with an equal number or set of discharge openings arranged to opposed sides of the longitudinal axis 14 and with those openings disposed to either side of the longitudinal axis being generally aligned relative to each other longitudinally. In the embodiment illustrated by way of example in FIGS. 2 and 3, each discharge opening defined by hopper 12 has a generally rectangular marginal edge configuration.

According to this embodiment of the invention disclosure, an appropriately sized gate or door assembly is arranged in operable combination with each discharge opening comprising the respective discharge area at the bottom of the walled enclosure 12. That is, each discharge area at the bottom 30 of the walled enclosure 12 preferably has four side-by-side individual gate assemblies 52, 54, 56 and 58 (FIG. 2) mounted in operable combination therewith. Again, it should be appreciated, the number of discharge gates arranged in operable combination with the hopper 12 will be a function of the number of discharge openings associated with each discharge area on the hopper 12. In a preferred embodiment, the gate assemblies 52, 54, 56 and 58 are substantially identical relative to each other. In one form, the assemblies 52, 54, 56 and 58 are of the conventional type sold by Miner Enterprises, Inc. under Model Number MKE 10724; although any other conventional gate assembly would equally suffice. Preferably, the gate assemblies 52, 54, 56 and 58 are disposed to gravitationally discharge commodity from the hopper 12 between the rails 29, 29' (FIG. 1)

In the illustrated embodiment, the gate assemblies 52, 54 for each discharge area are preferably disposed in substantially aligned relation longitudinally relative to each other. In the illustrated embodiment, the gate assemblies 56 and 58 for each discharge area are also preferably disposed in substantially aligned relation longitudinally relative to each other. Whereas, the gate assemblies 52 and 56, arranged and disposed to opposite lateral sides of the longitudinal axis 14 of the car 10, are preferably in substantially aligned relation laterally relative to each other. Moreover, the gate assemblies 54 and 58 of each discharge area, arranged and disposed to opposite lateral sides of the longitudinal axis 14 of the car 10, are preferably in substantially aligned relation laterally relative to each other.

In the illustrated embodiment, and since the gate assemblies 52, 54, 56 and 58 are substantially similar to each other, only one gate assembly will be described in detail. As illustrated by way of example in FIGS. 4, 5 and 6, each gate assembly includes a rigid frame 60 preferably defining a generally rectangular discharge outlet 62 arranged in generally registry or material receiving relation with one of the discharge openings comprising one of the discharge areas on the car 10 (FIG. 2). Frame 60 of gate assembly preferably includes four frame members 63, 64, 65 and 66 rigidly interconnected to each other in a generally rectangular pattern.

To facilitate mounting each gate assembly to suitable structure on hopper 12, each frame member 63, 64, 65 and 66 preferably terminates toward an upper end in an apertured and generally horizontal flange 67 extending outward and away from the discharge outlet of the respective gate. The apertured horizontal flanges 67 on the frame members 63, 64, 65 and 66 of each gate assembly are arranged in generally coplanar relationship relative to each other. Although the method of interface of each gate assembly 52, 54, 56 and 58 with hopper 12 is illustrated as being with a generally horizontal flange 67, it will be appreciated the flange 67 can also be slopped or angled to substantially correspond with the downward slope or angle of the depending chute wall of the hopper 12 leading to the respective discharge opening and be suitably secured thereto, as by welding or the like, without detracting or departing from the spirit and scope of this invention disclosure.

Each gate assembly furthermore includes a gate or slide door 70 mounted on the respective frame below the flanges 67 for sliding movement preferably in a generally horizontal path of travel. Notably, in the embodiment illustrated by way of example in FIGS. 2 and 3, the slide door 70 of each gate assembly moves in a direction extending generally normal or perpendicular to the longitudinal axis 14 of the car 10. As such, the sliding door 70 of each gate assembly is advantageously not subject to the above-mentioned longitudinal forces which tends to inadvertently open the slide door from a closed position. This design furthermore reduces—if not eliminates—the need for a lock assembly to be associated with each gate assembly for releasably holding the slide gate in the closed position.

With the arrangement illustrated for exemplary purposes in FIG. 2, two gate assemblies 52 and 54 for each discharge area 32, 34 are disposed to one lateral side of the longitudinal axis 14 of car 20 while the two gate assembles 56 and 58 for each discharge area are disposed to an opposed lateral side of the longitudinal axis 14 of car 10. Suffice it to say, the slide door 70 of each gate assembly is movable anywhere between and to a first or closed position (FIGS. 2, 3, 4 and 5), wherein each slide door 70 fully closes or blocks the respective discharge outlet 62 defined by the associated gate assembly, and a second or open position FIG. 6. When the slide door is in the second or open position, material is permitted to gravitationally exit or pass through the respective discharge outlet defined by the associated gate assembly from the respective discharge opening in the hopper 12.

Notably, and in the embodiment illustrated by way of example in FIGS. 2 and 3, the sliding doors operably associated with gate assemblies disposed on opposite sides of the longitudinal axis 14 of car 10 move in opposite directions relative to each other when moving between the first and second positions. As such, the materials gravitationally discharged from the hopper 12 are likely to predominately fall between the rails. Although the slide door 70 of each gate assembly moves in directions extending generally perpendicular to the longitudinal axis 14 of the car 10, the trailing edge of the doors remain within the confines or limits defined by the AAR.

Figure 4:
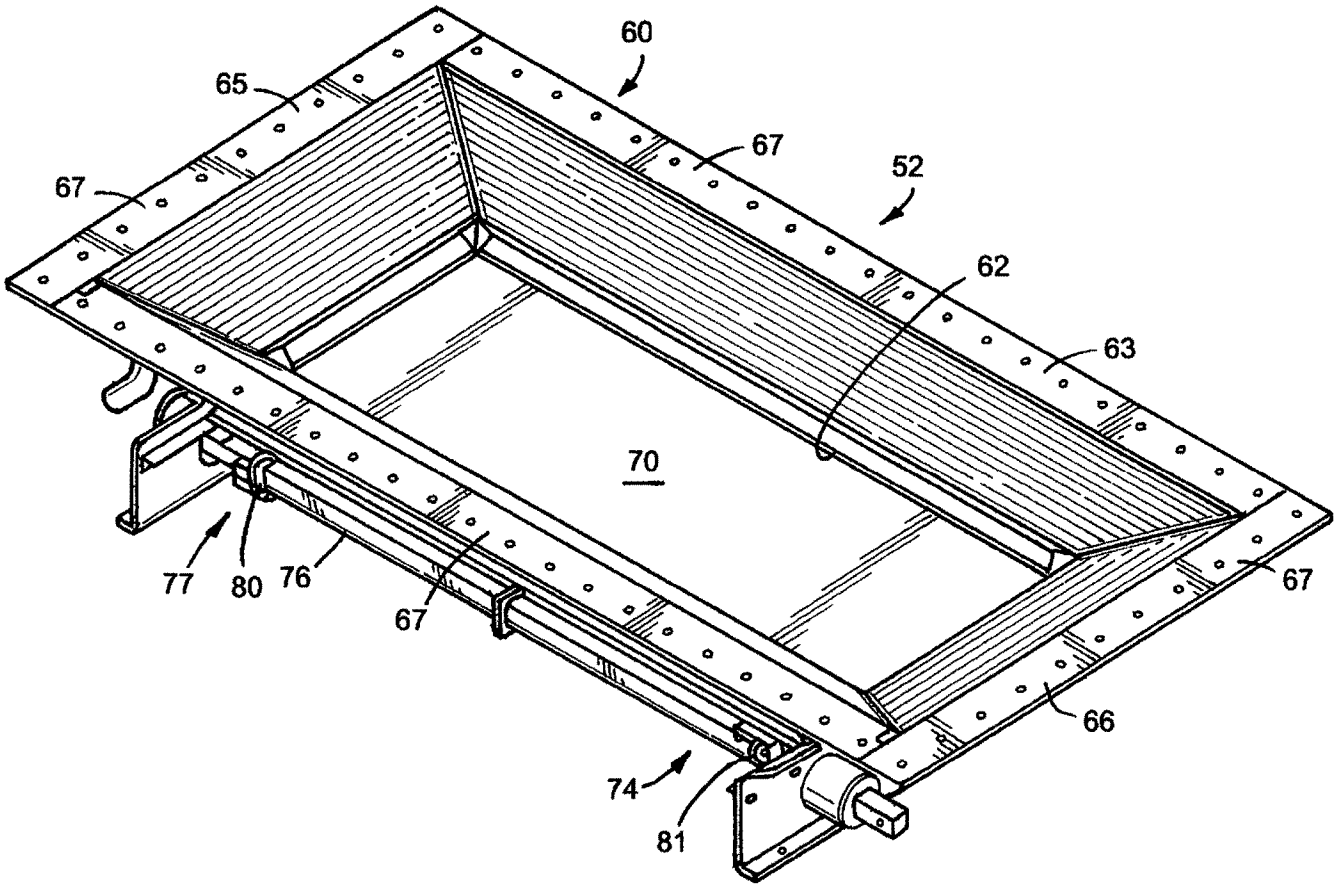
FIG. 4 is a perspective view of one form of gate assembly arranged in operable combination with the present invention disclosure.
Figure 5:
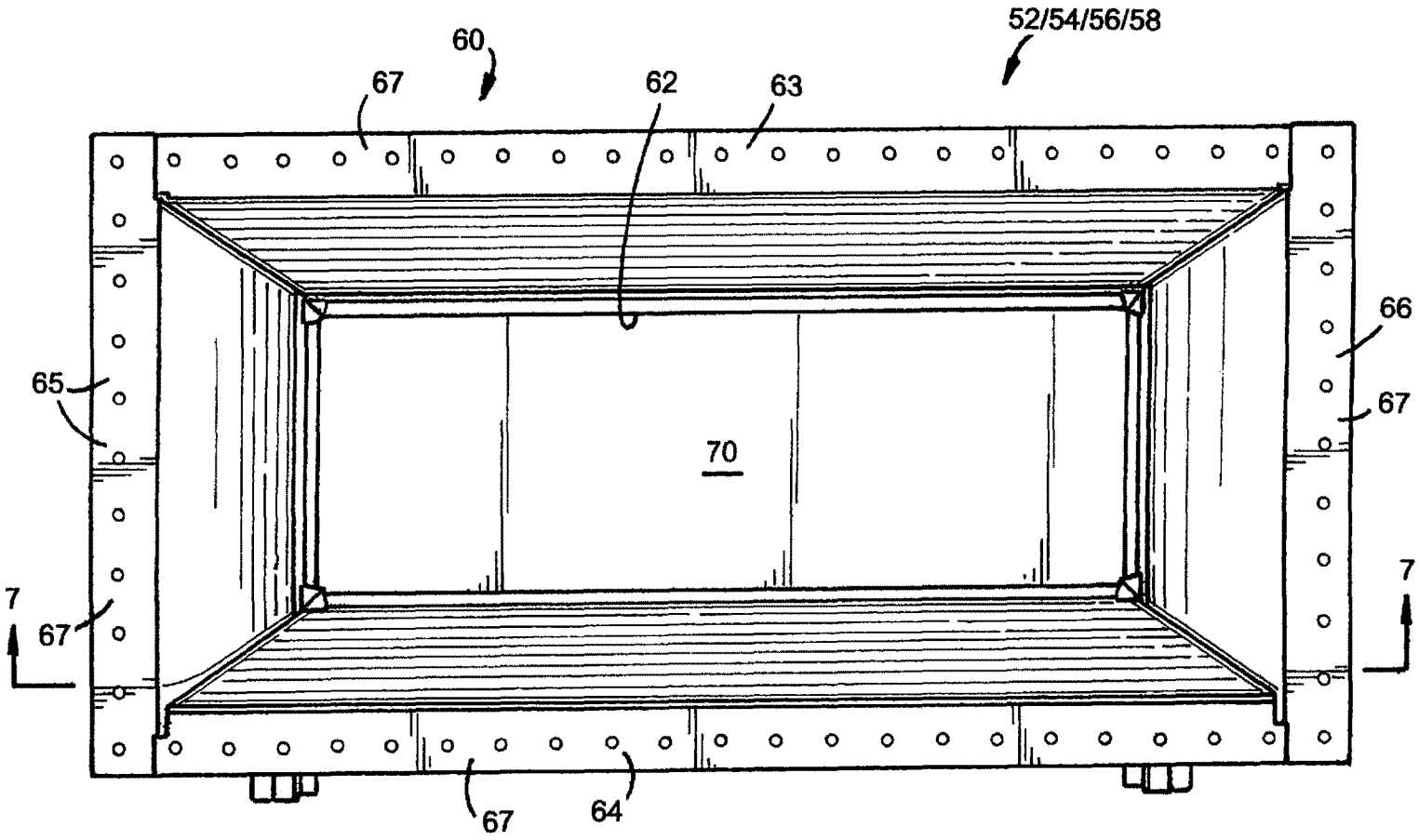
FIG. 5 is a top plan view of the gate assembly illustrated in FIG. 4 and showing a slide door of the gate assembly in a first or closed position.
Figure 6:
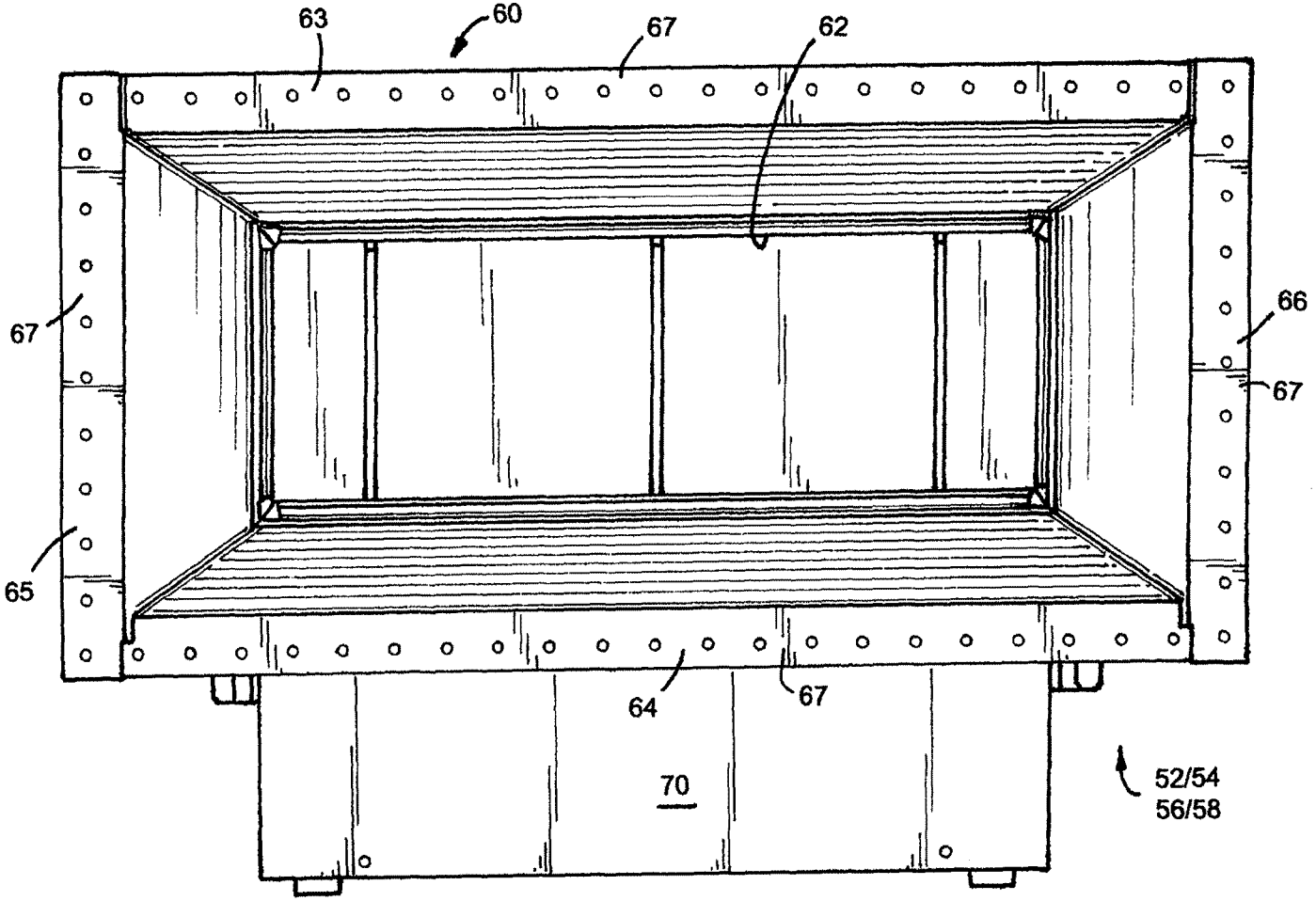
FIG. 6 is a top plan view similar to FIG. 5 but showing the slide door of the gate assembly in a second or open position.

As shown by way of example in FIGS. 4 and 5, each gate assembly further includes a suitable drive apparatus 74 for moving the respective slide door 70 thereof anywhere between and to the first or closed position and the second or open position and relative to the discharge outlet of the respective gate assembly. In one form, drive apparatus 74 includes an elongated drive shaft assembly 75 including an elongated drive shaft 76 which is mounted on the frame of the respective gate assembly and is rotatable about a fixed axis 77 extending generally parallel to the longitudinal axis 14 of car 10 (FIG. 2). When mounted to the hopper 12, the elongated drive shaft assembly 75, and more specifically, the drive shaft 76 on the drive shaft assembly 75 of those gate assemblies disposed to one lateral side of the longitudinal axis 14 of car 10 (FIG. 2) are generally aligned both vertically and longitudinally relative to each other. Similarly, and when mounted to hopper 12, the elongated drive shaft assembly 75, and more specifically, the drive shaft 76 on the drive shaft assembly 75 of those gate assemblies disposed to an opposed lateral side of the longitudinal axis 14 of car 10 are generally aligned both vertically and longitudinally relative to each other.

Figure 7:
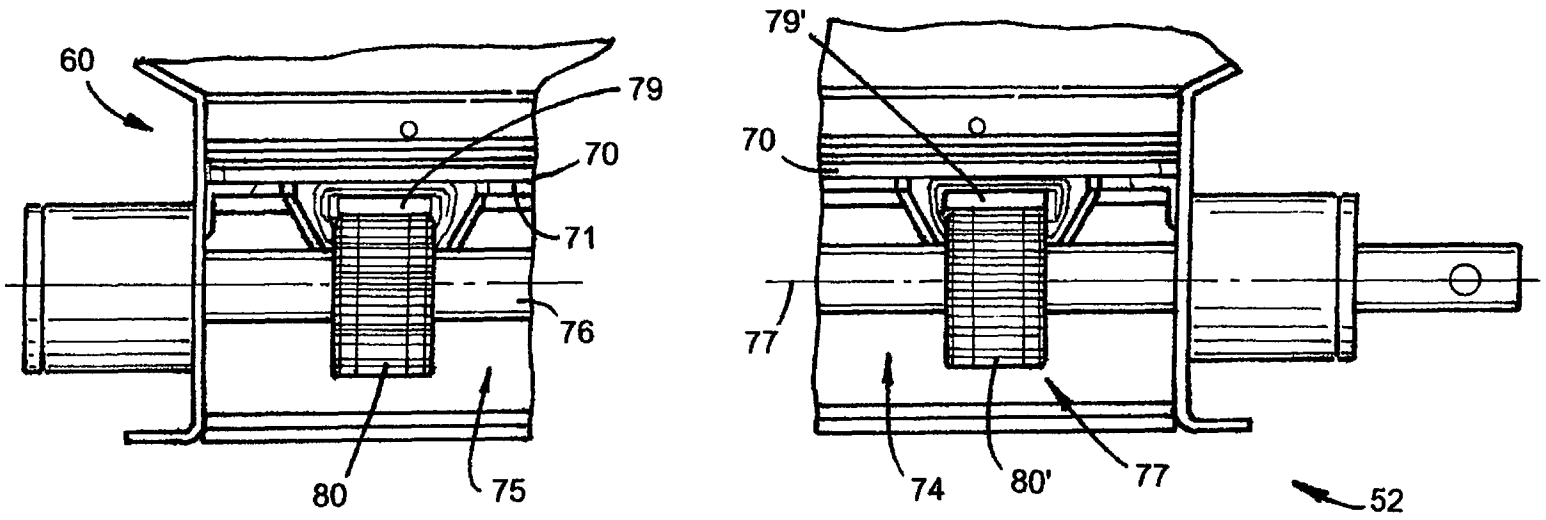
FIG. 7 is a fragmentary sectional view taken along line 7-7 of FIG. 5.

In the embodiment illustrated in FIGS. 4 and 7, the drive apparatus 74 associated with each gate assembly for moving the respective slide door thereof between positions and relative to the discharge outlet of the respective gate assembly furthermore includes a mechanism for converting rotational movements of the drive shaft assembly 75 into linear movements of the slide door 70 of the respective gate assembly. In one form, such mechanism includes a conventional rack and pinion assembly 77. It will be appreciated, however, other devices and/or mechanisms can be used for converting rotational movements of the drive shaft assembly 75 into linear movements of the slide door 70 of the respective gate assembly without detracting or departing from broad spirit and scope of this invention disclosure.

In the embodiment shown by way of example in FIG. 7, the rack and pinion assembly 77 of each gate assembly preferably includes a pair of laterally spaced racks 79, 79' provided on an underside 71 of the respective slide door 70 to be moved along with a pair of laterally spaced pinion gears 80, 80' arranged in intermeshing relationship with the racks 79, 79', respectively. The pinion gears 80, 80' are arranged on the drive shaft 76 such that rotation of the drive shaft assembly 75 of the respective gate assembly results in linear displacement of the respective slide door in a direction dependent upon the rotational direction of shaft 76 about axis 77.

Figure 8:
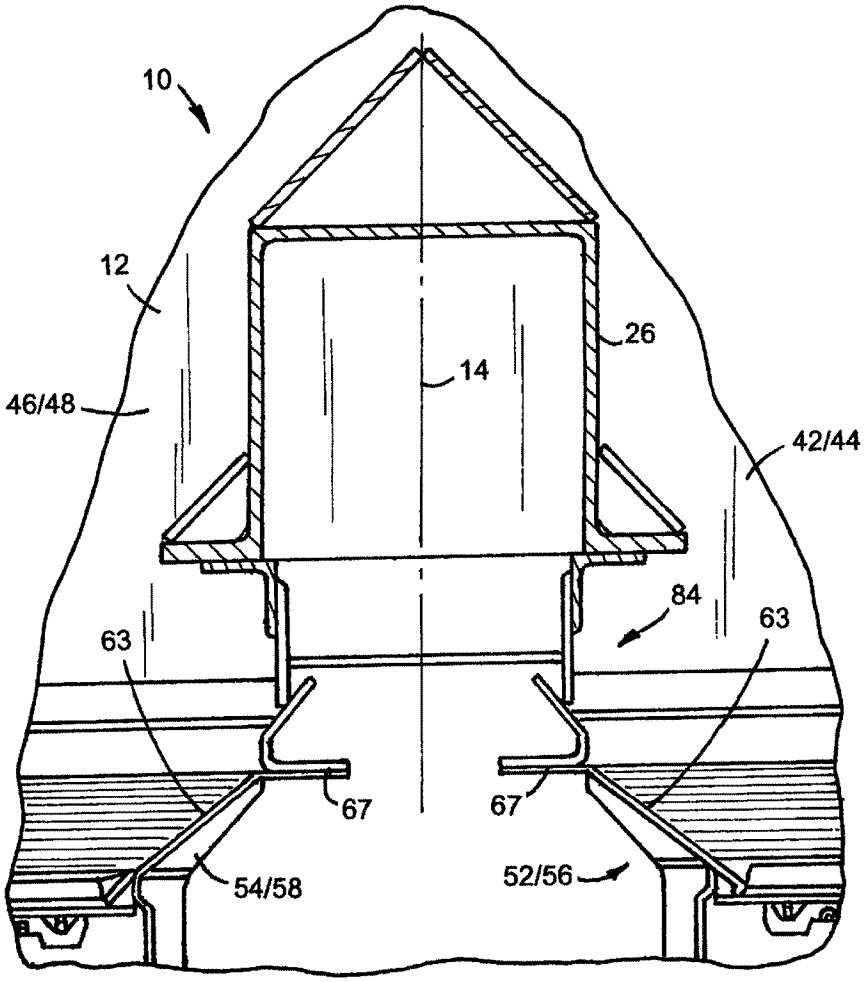
FIG. 8 is an enlarged fragmentary sectional view taken along line 8-8 of FIG. 3.

As will be appreciated by those skilled in the art, providing the openings 42, 44, 46 and 48 in the disclosed arrangement, along with arranging the gate assemblies 52, 54, 56 and 58 such that the respective slide door 70 thereon moves laterally relative to the longitudinal axis 14 of the hopper car 10 (FIG. 2) rather than longitudinally thereof, coupled with the manner in which the gate assemblies 52, 54, 56 and 58 are mounted to the hopper 12 significantly and advantageously adds to the volumetric or carrying capacity of the walled enclosure 12 on the car 10 (FIG. 2). All four horizontal flanges 67 on each gate assembly are securely fastened to suspend the gate assembly in registry with one of the respective openings defining each discharge area of the hopper 10. In the example illustrated in FIG. 8, the generally horizontal flange 67 on the longitudinally extending frame member 63 of each gate assembly 52, 54, 56 and 58 is secured to suitable structure 84 depending from the center sill 26 on car 10 The flange 67 on the other longitudinally extending frame member 64 of each gate assembly is suitably secured to a conventional flange on the hopper 12 (not shown). As illustrated in FIG. 8, a conventional hood 86 having an inverted generally V-shaped configuration is arranged and carried by an upper surface of the center sill 26 and serves to add to the lateral separation of the discharge openings 42, 46 and 44, 48 relative to each other.

Figure 9:
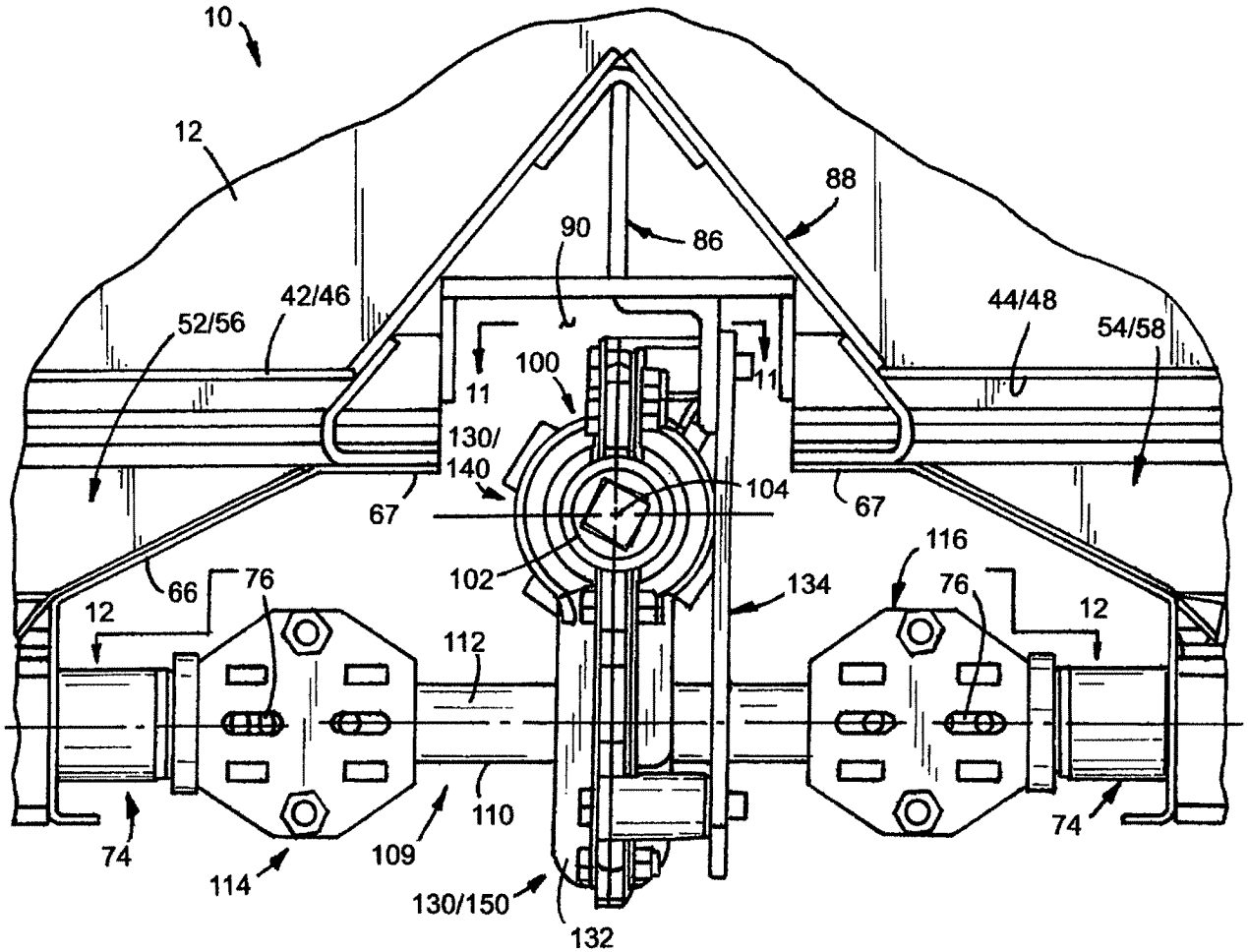
FIG. 9 is an enlarged fragmentary sectional view taken along line 9-9 of FIG. 3.

Turning now to the embodiment illustrated by way of example in FIG. 9, the generally horizontal flange 66 on the frame member 63 of each gate assembly 52, 54, 56 and 58 is secured to suitable structure 86 rigidly secured to and extending in opposed lateral directions from the center sill 26 on car 10 The horizontal flange 67 on the opposed frame member 65 (FIG. 4) of each gate assembly 52, 54, 56 and 58 is secured to suitable structure (not shown) on the hopper or walled enclosure 12 of car 10 whereby securing all four frame members of each gate assembly to the hopper 12 of car 10.

In the embodiment illustrated by way of example in FIG. 9, a laterally extending conventional hood 88, preferably having an inverted generally V-shaped configuration, extends in opposed lateral directions from the hood 86 and above each mounting structure 86 to facilitate separation of the discharge openings 42, 44 and 46, 48 relative to each other. Moreover, each hood 88 provides a laterally elongated opening or space 90 therebeneath and between the openings 42, 44 and 46, 48. In one form, the space 90 provided beneath each hood 88 is used to facilitate placement of an apparatus or mechanism 100 for operating each of the gate assemblies 52, 54, 56 and 58 conjointly or simultaneously relative to each other whereby advantageously effecting a rapid discharge of material from the hopper or walled enclosure 12 after the car 10 reaches a location where the materials in hopper 12 are to be discharged therefrom. That is, the apparatus or mechanism 100 is capable of simultaneously moving each of the sliding doors anywhere between and to a first position, wherein each slide door is positioned to fully close the respective discharge opening comprising part of the respective discharge area, and a second position, wherein each slide door is positioned to open the respective discharge opening comprising part of the respective discharge area thereby allowing commodity in the car body 12 to gravitationally escape therefrom.

Figure 10:
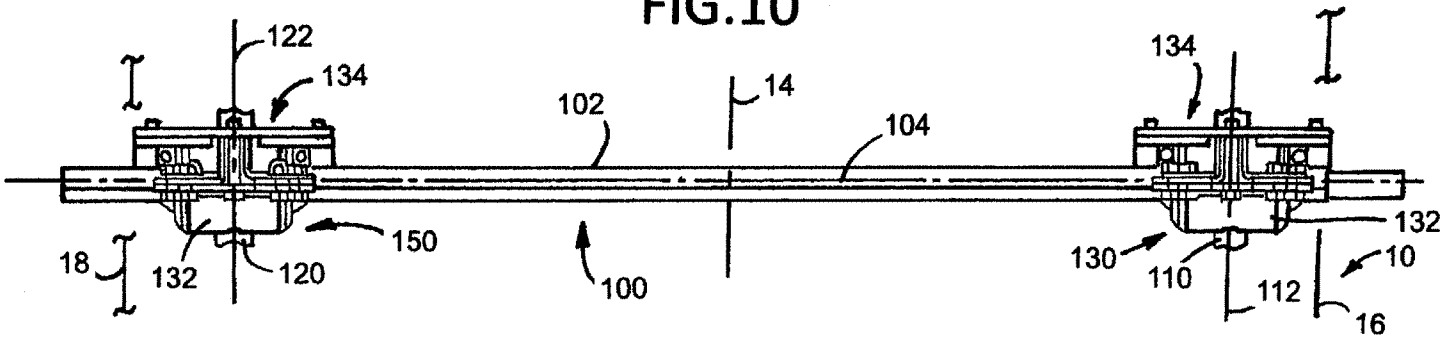
FIG. 10 is a top plan view of an apparatus for operating each of a plurality of gate assemblies conjointly or simultaneously relative to each other.

In a preferred embodiment shown in FIGS. 9 and 10, the apparatus 100 for operating each of the gate assemblies 52, 54, 56 and 58 conjointly or simultaneously relative to each other includes a laterally elongated single operating shaft 102 mounted on the hopper 12 of car 10 for rotation about a fixed axis 104. As used herein and throughout, the phrase "single operating shaft" means and refers to a one piece or multipiece assembly which functions and operates to transfer rotation in either direction as a result of a rotational force being applied to either end thereof. As schematically illustrated in FIG. 10, the fixed axis 104 about which the operating shaft 102 rotates extends generally normal to the longitudinal axis 14 of the hopper car 10. Moreover, and as shown by way of example in FIG. 9, the operating shaft 102 and the fixed axis 104 defined thereby preferably extend laterally between the gate assemblies 52 and 54 as well as the gate assemblies 54 and 56. That is, the gate assemblies 52, 56 are disposed to one longitudinal side of axis 104 while gate assemblies 54 and 58 are disposed to an opposite longitudinal side of axis 104.

As further schematically illustrated in FIG. 10, and to facilitate access thereto, at least one end of the operating shaft 102 of apparatus 100 extends adjacent to one lateral side 16 of the hopper railcar 10. In a preferred embodiment, and so as to facilitate operation of apparatus 100 from either side of car 10, opposed ends of the operating shaft 102 are disposed for access to opposed lateral sides 16 and 18 of the railcar hopper car 10. Moreover, opposite ends of the shaft 102 are configured to promote rotation of shaft 102 about axis 102 in either direction.

Figure 11:
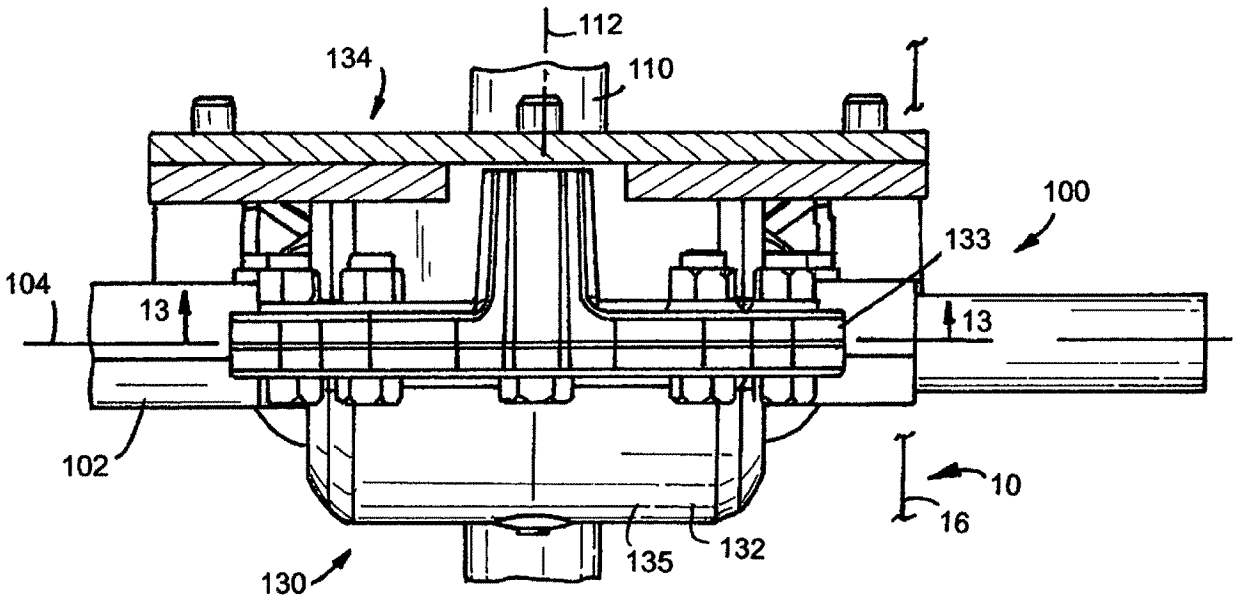
FIG. 11 is an enlarged fragmentary view of the area encircled in FIG. 10.
Figure 12:
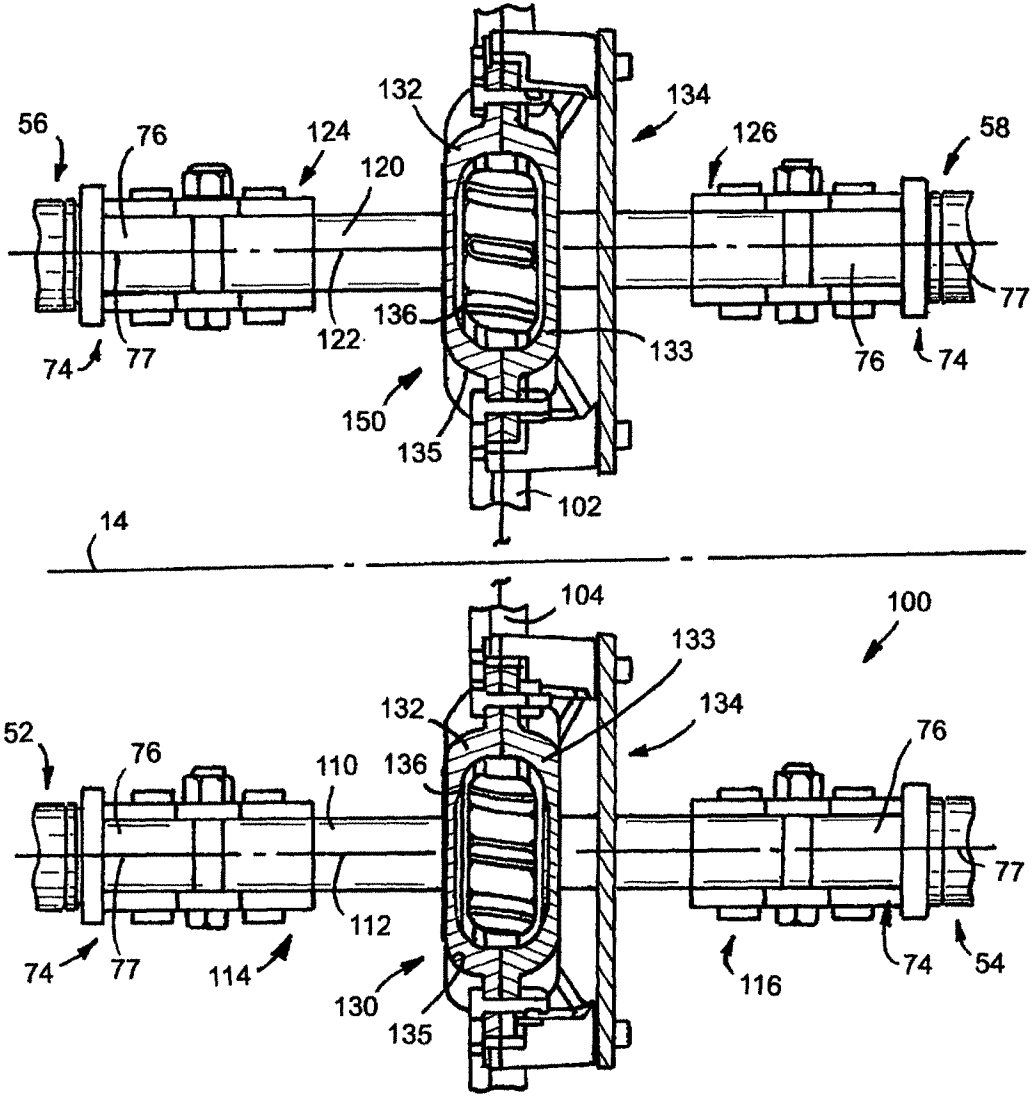
FIG. 12 is an enlarged fragmentary sectional view.

As shown in FIGS. 10 and 11, apparatus 100 also includes a first drive shaft 110 defining an axis 112 about which shaft 110 turns in either rotational direction and extending generally parallel to the longitudinal axis 14 of car 10. Shaft 110 is operably connected to the operating shaft 102. As shown in FIGS. 10 and 12, apparatus 100 furthermore includes a second drive shaft 120 defining an axis 122 about which 120 turns in either rotational direction and extending generally parallel to the longitudinal axis 14 of car 10. Shaft 120 is also operably connected to the operating shaft 102.

In the embodiment illustrated in FIG. 12, the first drive shaft 110 of apparatus 100 is operably connected, toward opposite ends thereof, to the operating shaft 76 associated with the apparatus 74 used to move slide door 70 of anywhere assembly 52 between and to closed and open positions and to the operating shaft 76 associated with the apparatus 74 used to move slide door 70 of assembly 54, disposed to an opposite side of axis 102, anywhere between and to closed and open positions. As illustrated by way of example in FIG. 12, the second drive shaft 120 of apparatus 100 is operably connected, toward opposite ends thereof, to the operating shaft 76 associated with the apparatus 74 used to move slide door 70 of assembly 56 anywhere between and to closed and open positions and to the operating shaft 76 associated with the apparatus 74 used to move slide door 70 of assembly 58, disposed to an opposite side of axis 102, anywhere between and to closed and open positions.

In the embodiment illustrated by way of example in FIGS. 9 and 11, a first coupling 114 is operably disposed and serves to transfer rotary movements between the opposed and free ends of the operating shaft 76 associated with the apparatus 74 used to move slide door 70 of gate assembly 52 and the first drive shaft 110 of apparatus 100. In the embodiment illustrated by way of example in FIGS. 9 and 11, a second coupling 116 is operably disposed and serves to transfer rotary movements between the opposed and free ends of the operating shaft 76 associated with the apparatus 74 used to move slide door 70 of gate assembly 52 and the first drive shaft 110 of apparatus 100. Besides transferring rotary movements and torque between the coupled pieces, each coupling 114, 116 is preferably designed to accommodate tolerance variations and allow for adjustments between the joined pieces during assembly of the gate assemblies and apparatus 100.

As illustrated by way of example in FIG. 11, another coupling 124 is operably serves to transfer rotary movements between the opposed and free ends of the operating shaft 76 associated with the apparatus 74 used to move slide door 70 of gate assembly 56 and the second drive shaft 120 of apparatus 100. In the embodiment illustrated by way of example in FIG. 11, yet another coupling 126 is operably disposed and serves to transfer rotary movements between the opposed and free ends of the operating shaft 76 associated with the apparatus 74 used to move slide door 70 of gate assembly 58 and the second drive shaft 120 of apparatus 100. Besides transferring rotary movements and torque between the coupled pieces, each coupling 124, 126 is preferably designed to accommodate tolerance variations and allow for adjustments between the joined pieces during assembly of the gate assemblies and apparatus 100.

As illustrated in FIG. 10, and to transfer rotational movements from the single operating shaft 102 to simultaneous linear movements of the slide door of each gate assembly, the apparatus 100 further includes a first force transfer mechanism or first right angle gear box 130 and a second force transfer mechanism or second right angle gear box 150, both of which operate in unison with and in response to rotational movements of the operating shaft 102. With the exception of their rotational outputs, the first force transfer mechanism 130 and second force transfer mechanism 150 are preferably similar to each other in design and operation. To effect the desired ends of having the slide door 70 of the gate assemblies 52, 54 simultaneously move in an opposite direction from the slide door 70 of the gate assemblies 56, 58, the output of the first force transfer mechanism 130 turns or rotates in an opposite direction from the output of the second force transfer mechanism 150 in response to rotation of the operating shaft 102. As will be understood from what follows, each force transfer mechanism 130 and 150 furthermore advantageously serves as a positive lock for inhibiting inadvertent displacement of the slide door of each gate assembly.

In the illustrated embodiment, the first and second force transfer mechanisms 130 and 150, respectively, are of the type sold by Miner Enterprises, Inc. under Part No. W42717 and W42718, respectively. As mentioned, and with the exception of their direction of rotational output, the first force transfer mechanism 130 and second force transfer mechanism 150 are substantially similar to each other in design and operation. As such, only the first force transfer mechanism 130 will be discussed in detail.

As illustrated by way of example in FIGS. 9 and 11, each force transfer mechanism or right angle gear box includes a housing 132. The housing 132 of each force transfer mechanism is suspended in the space 90 beneath the hood 88. In the form shown by way of example in FIG. 9, suitable support structure 134 connected to the structure 86 rigidly secured to and extending in opposed lateral directions from the center sill 26 on car 10 is preferably used to suspend the housing 132 of the first and second force transfer mechanisms 130 and 140, respectively, in axially aligned relation relative to each other.

As shown by way of example in FIG. 11, the housing 132 of each force transfer mechanism or right angle gear box is preferably configured with clam-shaped pieces 133 and 135 which are fastened, bolted or otherwise releasably secured to each other and define a cavity 136 (FIG. 12) therebetween. Mounted for rotation within the cavity 136 defined by housing 132 is an input gear 137 and an output gear 139 arranged in intermeshing relationship relative to each other. The intermeshing relationship between the gears 137 and 139 of each force transfer mechanism advantageously serves to inhibit inadvertent rotation of the drive shaft 110, 120 extending therefrom whereby allowing each force transfer mechanism to further serve as a positive lock for the gate assemblies operated thereby.

Figure 13:
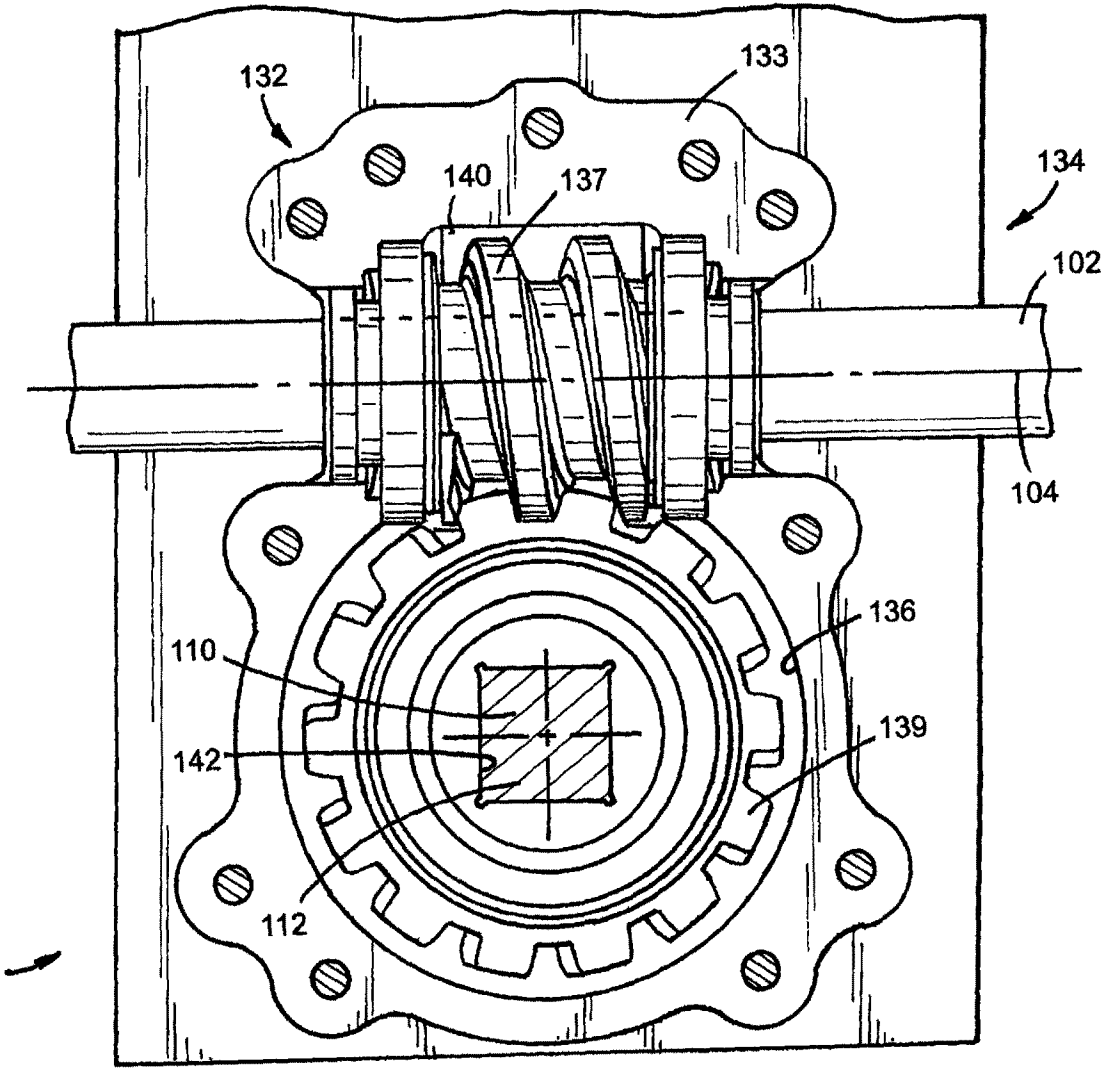
FIG. 13 is a sectional view taken along line 13-13 of FIG. 11.

In the embodiment illustrated by way of example in FIG. 13, the input gear 137 of each right angle gear box 130, 150 defines a throughbore 140 which locates and fixes the axis 104 of the operating shaft 102 passing therethrough. Preferably, the throughbore 140 defined by the input gear 137 of each right angle gear box 130, 150 has a cross-sectional configuration which substantially corresponds to the cross-sectional configuration of the operating shaft 102 passing therethrough such that, upon rotation of the operating shaft 102, there is substantially no slippage relative to the input gear 137.

In the embodiment illustrated by way of example in FIG. 13, the output gear 137 defines a throughbore 142 which locates and fixes the axis 112, 122 of the drive shaft 110, 120 (FIG. 10) passing therethrough. Preferably, the throughbore 142 defined by the output gear 139 of each right angle gear box 130, 150 has a cross-sectional configuration which substantially corresponds to the cross-sectional configuration of the drive shaft 110, 120 passing therethrough such that, upon rotation of the operating shaft 102, there is substantially no slippage relative to the input gear 139.

In the illustrated embodiment, the input gear 137 and output gear 139 of each right angle gear box 130, 150 preferably have a gear ratio of about 5:1. Of course, other gear ratios can be established between the input gear 137 and output gear 139 of each right angle gear box 130, 150 without detracting or departing from the spirit and scope of this invention disclosure, As will be appreciated by those skilled in the art, the right angle gear boxes 130 and 150 can use any of a combination of worm gears, helical gears, bevel gears, hypoid gears or any other set of gears operable to transfer torque between perpendicular shafts without detracting or departing from the spirit and scope of this invention disclosure.

Although not shown, and rather than extending between the gate assemblies 52, 56 and 54, 58, it is within the spirit and scope of this invention disclosure for the operating shaft 102 to be located to either side of the gate assemblies 52, 56 or 54, 58 and be operably connected to axially conjoined drive shafts 76 of each gate assembly. As with the invention disclosure mentioned above, in this alternative configuration, the single operating shaft 102 would be used to simultaneously and conjointly move the slide door 70 of each assembly 52, 54, 56 and 58 anywhere between and to closed and open positrons.

In operation, the slide door 70 of each gate assembly 52, 54, 56 and 58 is conjointly opened upon rotation of the single operating shaft 102 in an appropriate direction. When the operating shaft 102 is rotated, the input of each force transfer mechanism 130, 150 is positively rotated therewith about the fixed axis 104. Because of the intermeshing relationship between the input and output gears 137 and 139, respectively, of each force transfer mechanism 130, 150 the rotation of operating shaft results in positive rotation of the drive shafts 110 and 120 extending from the first and second force transfer mechanism 130 and 150, respectively (FIG. 10), in opposed rotational directions relative to each other.

Returning to FIG. 12, rotation of the drive shafts 110, 120 is thereafter transferred to the drive shaft 76 of the apparatus 74 associated with each gate assembly 52, 54, 56, 58 for moving each slide door 70. As will be appreciated from an understanding of this invention disclosure, the opposed rotational movements of the shafts 110, 120 results in movements of the slide door of the gate assemblies 52, 56 and 54, 58 in opposed linear directions relative to each other as they move between closed and open positions and vice versa. As such, rotation of the operating shaft 102 about the fixed axis 104 forcibly and conjointly moves the slide door 70 of each gate assembly 52, 54, 56 and 58 anywhere between and to closed and open positions as a function of the direction of rotation of the operating shaft 102.

Figure 14:
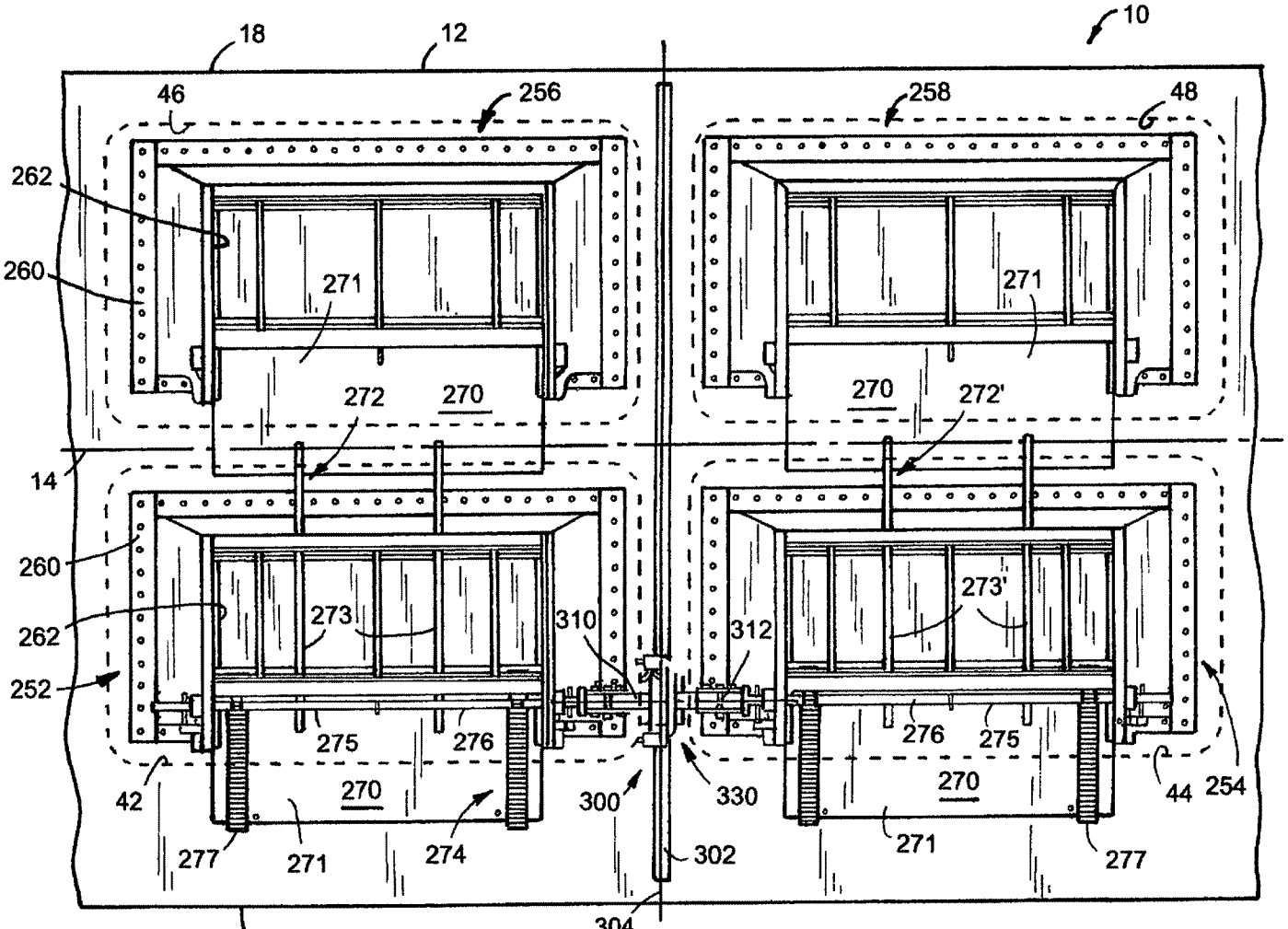
FIG. 14 is a schematic bottom plan view of another embodiment of this invention disclosure.

FIG. 14 illustrates an alternative embodiment of the present invention disclosure wherein reference numerals similar to those listed above are used to identify like parts. In the embodiment illustrated in FIG. 14, each discharge area of hopper 12 includes a plurality of discharge openings arranged in pattern relative to each other for allowing or permitting material in the hopper 12 to be rapidly and gravitationally discharged in a controlled manner therefrom. In the embodiment illustrated in FIG. 14, each discharge area at the bottom of the hopper 12 includes a plurality of discharge openings arranged in a pattern relative to each other. As illustrated in FIGS. 2 and 3, in the embodiment illustrated in FIG. 14, each discharge area at the bottom of hopper 12 includes four discharge openings 42, 44, 46 and 48 arranged in a side-by-side pattern relative to each other to enhance the cubic capacity of the hopper 12 and improve stability of the car by lowering the center of gravity of the car.

In the embodiment illustrated by way of example in FIG. 14, the discharge openings 42, 44 and 46, 48 arranged and disposed to respective lateral sides of the longitudinal axis 14 of the car 10 are in substantially aligned relation longitudinally relative to each other. Whereas, the discharge openings 42, 46 and 44, 48 arranged and disposed to opposite lateral sides of the longitudinal axis 14 of the car 10 are in substantially aligned relation laterally relative to each other. Suitable hood structure (not shown) similar to that discussed above, is used to operably separate the discharge opening from each other. It should be appreciated, however, the number of discharge openings comprising each discharge area can be greater than four without detracting or departing from the novel spirit and scope of this invention disclosure. In the embodiment illustrated by way of example in FIG. 14, each opening defined by hopper 12 has a generally rectangular marginal edge configuration.

According to this embodiment of the invention disclosure, an appropriately sized gate or door assembly is arranged in operable combination with each discharge opening comprising the respective discharge area at the bottom of the walled enclosure 12. That is, each discharge area at the bottom 30 of the walled enclosure 12 preferably has four side-by-side individual gate assemblies 252, 254, 256 and 258 arranged in operable combination therewith. Preferably, the gate assemblies 252, 254, 256 and 258 are disposed to gravitationally discharge commodity or material between the rails 29, 29' (FIG. 1). Again, it should be appreciated, the number of discharge gates arranged in operable combination with the hopper 12 will be a function of the number of discharge openings associated with each discharge area on hopper 12. Preferably, the gate assemblies 252 and 254 are substantially similar while the gate assemblies 256 and 258 are preferably similar with each other. In one form, the gate assemblies 252 and 254 are of the conventional type sold by Miner Enterprises, Inc. under Model Number MKE 10724; although any other conventional gate assembly would equally suffice.

With the arrangement illustrated for exemplary purposes in FIG. 14, and when mounted on car 10, the two gate assemblies 252 and 254 for the discharge openings 42 and 44, respectively, are disposed to one lateral side of the longitudinal axis 14 of car 20 while the gate assemblies 256 and 258 for the discharge openings 46 and 48, respectively, are disposed to an opposed lateral side of the longitudinal axis 14 of car 10. In the embodiment illustrated by way of example in FIG. 14, the gate assemblies 252, 254 are preferably disposed in substantially aligned relation longitudinally relative to each other. In the embodiment illustrated by way of example in FIG. 14, the gate assemblies 256 and 258 are also preferably disposed in substantially aligned relation longitudinally relative to each other. Whereas, the gate assemblies 252 and 256, arranged and disposed to opposite lateral sides of the longitudinal axis 14 of the car 10, are preferably in substantially aligned relation laterally relative to each other. Moreover, the gate assemblies 254 and 258 of each discharge area, arranged and disposed to opposite lateral sides of the longitudinal axis 14 of the car 10, are preferably in substantially aligned relation laterally relative to each other.

In the illustrated embodiment, and since the gate assemblies 252 and 254 are substantially similar to each other, only one gate assembly will be described in detail. As illustrated by way of example in FIG. 14, the gate assemblies 252 and 254 each include a rigid frame 260 preferably defining a generally rectangular discharge outlet 262 arranged in generally registry or material receiving relation with one of the discharge openings partially comprising one of the discharge areas on car 10. Suffice it to say, the frame 260 of each gate assembly is similar to that described above regarding frame 60.

Each gate assembly 252 and 254 furthermore includes a gate or slide door 270 mounted on the respective frame for movement preferably in a generally horizontal path of travel. Notably, in the embodiment illustrated by way of example in FIG. 14, the door 270 of each gate assembly moves in a direction extending generally normal or perpendicular to the axis 14 of the car 10. As mentioned above, and with this design, the sliding door 270 is advantageously not subject to the above-mentioned longitudinal forces which tend to inadvertently open the slide door from a closed position. This design furthermore reduces—if not eliminates—the need for a lock assembly to be associated with each gate assembly for releasably holding the slide gate in the closed position. Although the doors 270 of gate assemblies 252 and 254 move in directions extending generally perpendicular to the longitudinal axis 14 of car 10, the trailing edge of the doors remain within the confines or limits defined by the AAR.

As shown by way of example in FIG. 14, each gate assembly 252 and 254 further includes a suitable drive apparatus 274 for positively moving the respective slide door thereof anywhere between and to the first or closed position and the second or open position and relative to the discharge outlet of the respective gate assembly. In one form, the drive apparatus 274 is substantially similar to the apparatus 74 described above for positively moving the respective slide door of the respective gate assembly. In the illustrated embodiment, the drive apparatus 274 for each gate assembly 252, 254 includes an elongated drive shaft assembly 275 including an elongated drive shaft 276 which is mounted on the frame of the respective gate assembly and extends generally parallel to the longitudinal axis 14 of car 10. As shown in FIG. 14, and when mounted to the hopper 12, the elongated drive shaft assembly 275, and more specifically, the drive shaft 276 on the drive shaft assembly 275 of the gate assemblies 252 and 254, are each disposed to one lateral side of the longitudinal axis 14 of car 10 and are generally aligned both vertically and longitudinally relative to each other.

In the embodiment illustrated in FIG. 14, the drive apparatus 274 associated with each gate assembly 252 and 254 for moving the respective slide door thereof between positions and relative to the discharge outlet of the respective gate assembly furthermore includes a mechanism for converting rotational movements of the drive shaft assembly 275 into linear movements of the slide door 70 of the respective gate assembly. In one form, such mechanism includes a conventional rack and pinion assembly 277 similar to assembly 77 described in detail above. It will be appreciated, however, other devices and/or mechanisms can be used for converting rotational movements of the drive shaft assembly 75 into linear movements of the slide door 70 of the respective gate assembly without detracting or departing from broad spirit and scope of this invention disclosure.

In the embodiment illustrated in FIG. 14, the gate assemblies 256 and 258 are substantially similar to each other and, thus, only one gate assembly will be described in detail. As illustrated, the gate assemblies 256 and 258 each include a rigid frame 260 defining a generally rectangular discharge outlet 262 arranged in generally registry or material receiving relation with one of the discharge openings partially comprising one of the discharge areas on car 10. Suffice it to say, the frame 260 of each gate assembly is similar to that described above regarding frame 60.

Each gate assembly 256 and 258 furthermore includes a gate or slide door 270 mounted on the respective frame for movement preferably in a generally horizontal path of travel. Notably, in the embodiment illustrated by way of example in FIG. 14, the slide door 270 of each gate assembly moves in a direction extending generally normal or perpendicular to the longitudinal axis 14 of the car 10. As mentioned above, and with this design, the sliding door 270 is advantageously not subject to the above-mentioned longitudinal forces which tends to inadvertently open the slide door from a closed position. This design furthermore reduces—if not eliminates—the required need for a lock assembly to be associated with each gate assembly for releasably holding the slide gate in the closed position. Although the slide door 270 of gate assemblies 252 and 254 moves in directions extending generally perpendicular to the longitudinal axis 14 of the car 10, the trailing edge of the doors remain within the confines or limits defined by the AAR.

In the embodiment illustrated in FIG. 14, the slide doors 270 of the third and fourth gate assemblies 256 and 258, respectively, are operably coupled to the slide doors 270 of the first and second gate assemblies 252 and 254, respectively. Notably, the designations or nomenclature "first", "second", "third" and "fourth" used above in connection with gate assemblies 252, 254, 256 and 258, respectively, are neither intended nor should they be considered, directly or indirectly, as denoting the importance of one gate assembly from the other. Such phrases or designations are used herein simply for purposes of convenience and should not be interpreted, directly or indirectly, as denoting anything further.

In the embodiment illustrated by way of example in FIG. 14, apparatus 272 is used to operably interconnect the sliding door 270 of the first gate assembly 252 with the sliding door 270 of the third gate assembly 256. Similarly, apparatus 272' is used to operably interconnect the sliding door 270 of the second gate assembly 254 with the sliding door 270 of the fourth gate assembly 258. In the illustrated embodiment, the design and configuration of apparatus 272 is such that it functions to operably pull the slide door 270 of the second gate assembly 256 from the closed position toward the open position in response to movement of the slide gate 270 of the first gate assembly 252 from the closed position toward the open position. In the illustrated embodiment, the design and configuration of apparatus 272 is such that it functions to operably push the slide door 270 of the second gate assembly 256 toward the closed position in response to movement of the slide gate 270 of the first gate assembly 252 toward the closed position. In the illustrated embodiment, the design and configuration of apparatus 272' functions in an equivalent manner on the slide gates 270 of the second and fourth gate assemblies 254 and 258, respectively. In the embodiment illustrated in FIG. 14, and when moved between positions, the slide doors 270 of the gate assemblies 252 and 256 move in the same direction relative to each other. Similarly, in the embodiment illustrated in FIG. 14, and when moved between positions, the slide doors 270 of the gate assemblies 254 and 258 move in the same direction relative to each other.

Preferably, each apparatus for operably interconnecting the sliding doors of the gate assemblies are substantially similar relative to each other. Apparatus 272 preferably includes a series of longitudinally spaced and elongated connectors 273 extending between the slide door 270 of the first gate assembly 252 and the slide gate 270 of the third gate assembly 256. The connectors 273 are arranged in generally normal or perpendicular relation relative to the axis 14 of car 10. Similarly, apparatus 272' preferably includes a series of longitudinally spaced and elongated connectors 273' extending between the slide door 270 of the second gate assembly 254 to the slide gate 270 of the third gate assembly 258. The connectors 273' are arranged in generally normal or perpendicular relation relative to the axis 14 of car 10. The spacing between connectors 273, 273 permits uninterrupted passage or flow of material thereover when commodity is to be gravitationally discharged from the hopper 12. In a preferred form, a length of each connector 273, 273' extends at least partially under and is suitably secured to an underside 271 of each slide gate 270. It will be appreciated, other design for operably interconnecting the sliding doors of the gate assemblies will equally suffice without detracting or seriously departing from the spirit and scope of this invention disclosure.

In the embodiment illustrated in FIG. 14, an apparatus or mechanism 300 is provided for operating each of the gate assemblies 252, 254, 256 and 258 conjointly or simultaneously relative to each other whereby advantageously effecting a rapid discharge of material from the hopper or walled enclosure 12 after the car 10 reaches a location whereat the materials in hopper 12 are to be discharged therefrom. That is, in the embodiment illustrated by way of example in FIG. 14, the apparatus or mechanism 300 is capable of simultaneously moving each of the sliding doors anywhere between and to a first position, wherein each slide door is positioned to fully close the respective discharge opening comprising part of the respective discharge area, and a second position, wherein each slide door is positioned to open the respective discharge opening comprising part of the respective discharge area thereby allowing commodity in the car body 12 to gravitationally escape therefrom.

As shown in FIG. 14, apparatus 300 includes a drive shaft 310 defining an axis 312 about which shaft 310 turns in either rotational direction and extending generally parallel to the longitudinal axis 14 of car 10. Shaft 310 is operably connected to the operating shaft 302. As in the embodiment illustrated in FIG. 10, the drive shaft 310 of apparatus 300 is operably connected, toward opposite ends thereof, to the operating shaft 276 associated with the drive apparatus 274 used to move slide door 270 of gate assembly 252 anywhere assembly between and to closed and open positions and to the operating shaft 276 associated with the drive apparatus 274 used to move slide door 270 of gate assembly 254 anywhere between and to closed and open positions.

In the embodiment shown by way of example in FIG. 14, the apparatus 300 for operating each of the gate assemblies 252, 254, 256 and 258 conjointly or simultaneously relative to each other is similar to the apparatus or mechanism 100 described above. That is, apparatus 300 includes a laterally elongated single operating shaft 302 mounted on the hopper 12 of car 10 for rotation about a fixed axis 304. As used herein and throughout, the phrase "single operating shaft" means and refers to a one piece or multipiece assembly which functions and operates to transfer rotation in either direction as a result of a rotational force being applied to either end thereof. As schematically illustrated in FIG. 14, the fixed axis 304 about which the operating shaft 302 rotates extends generally normal to the longitudinal axis 14 of the hopper car 10. Moreover, and as shown by way of example in FIG. 14, the operating shaft 302 and the fixed axis 304 defined thereby preferably extend laterally between the gate assemblies 252 and 254 as well as the gate assemblies 256 and 258. That is, the gate assemblies 252, and 254 disposed to opposite lateral sides of axis 104.

As further schematically illustrated in FIG. 14, and to facilitate access thereto, at least one end of the operating shaft 302 of apparatus 300 extends adjacent to one lateral side 16 of the hopper railcar 10. In a preferred embodiment, and so as to facilitate operation of apparatus 300 from either side of car 10, opposed ends of the operating shaft 302 are disposed for access to opposed lateral sides 16 and 18 of the railcar hopper car 10. Moreover, opposite ends of the shaft 302 are configured to promote rotation of shaft 302 about axis 304 in either direction.

As described above regarding apparatus 100, the operating shaft 302 of apparatus 300 is operably connected through the drive shaft 310 to the elongated drive shaft assembly 275 of each gate assembly 252 and 254. To transfer rotational movements from the single operating shaft 302 to simultaneous linear movements of the slide door of each gate assembly 252, 254, apparatus 300 further includes a force transfer mechanism or first right angle gear box 330 which operates in unison with and in response to rotational movements of the operating shaft 302. The force transfer mechanism 330 is substantially similar in design and operation to the force transfer mechanism 130 described in detail above. As with force transfer mechanism 130, the force transfer mechanism 330 furthermore advantageously serves as a positive lock for inhibiting inadvertent displacement of the slide door of either gate assembly 252, 254.

Although not shown, and rather than extending between the gate assemblies 252, 254 and 256, 258, it is within the spirit and scope of this invention disclosure for the operating shaft 302 to be located to either side of the gate assemblies 252, 256 or 254, 258 and be operably connected to axially conjoined drive shafts 276 of each gate assembly. As with the invention disclosure mentioned above, in this alternative configuration, the single operating shaft 302 would be used to simultaneously and conjointly move the slide door 70 of each assembly 252, 254 anywhere between and to closed and open positrons.

In operation, the slide door 270 of each gate assembly 252, 254, 256 and 258 is conjointly moved upon rotation of the single operating shaft 302 in an appropriate direction. When the operating shaft 302 is rotated, the force transfer mechanism 330 through drive shaft 310 effectively and efficiently operates the drive shaft assembly 275 of each gate assembly 252 and 254 to linearly move the slide door 270 associated therewith. Because the slide gate 270 of gate assembly 252 is operably connected to the slide door 270 of gate assembly 256 and the slide gate 270 of gate assembly 254 is operably connected to the slide door 270 of gate assembly 258, positive rotation of the shaft assembly 302 to move the slide doors will effect simultaneous movements of the multiple slide doors in unison relative to each other and relative to the respective discharge openings on the hopper whereby effecting rapid discharge of materials or commodity from the hopper 12.

Figure 15:
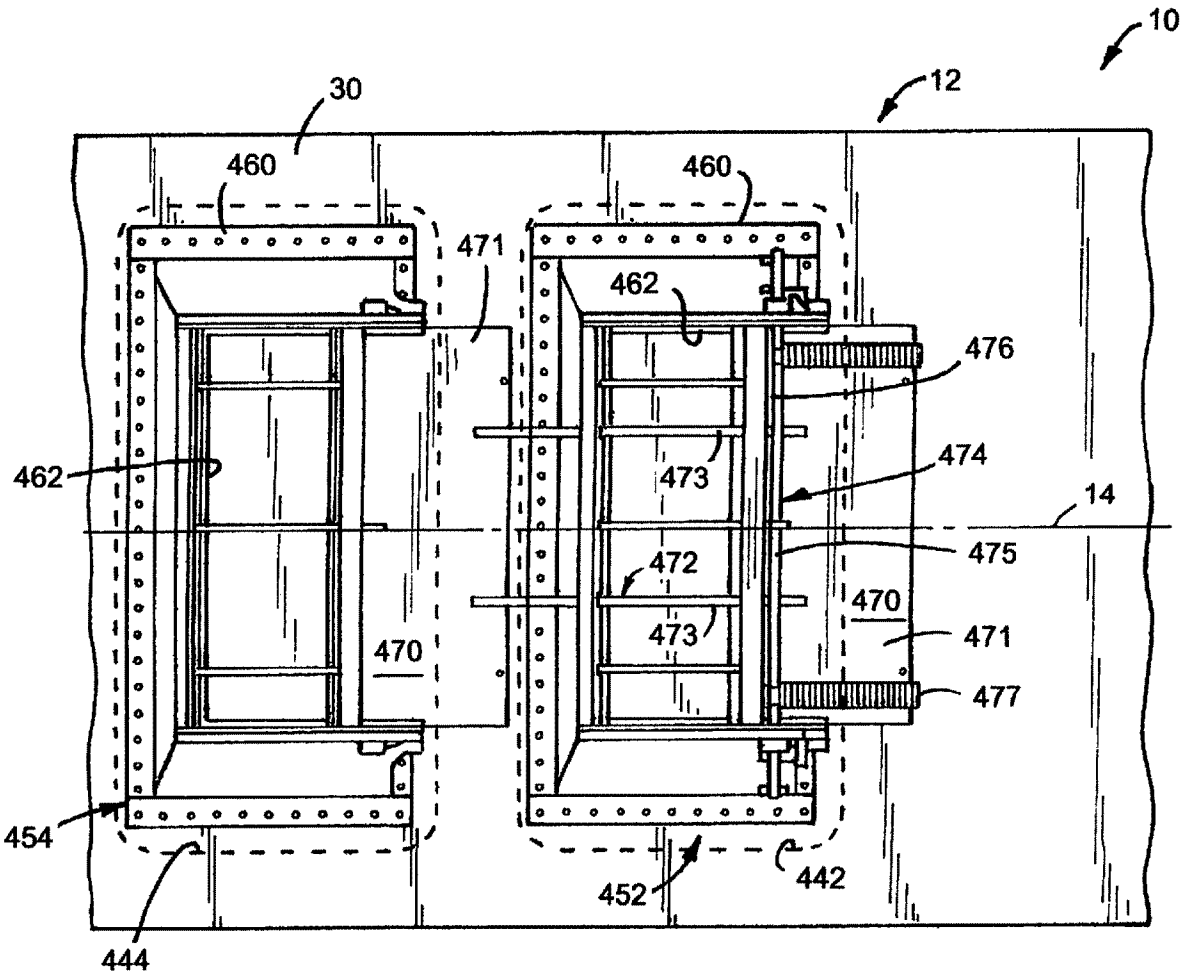
FIG. 15 is a schematic bottom plan view of yet another embodiment of this invention disclosure.

FIG. 15 illustrates another alternative embodiment of the present invention disclosure wherein reference numerals similar to those listed above are used to identify like parts. In the embodiment illustrated in FIG. 15, each discharge area of hopper 12 includes a two discharge openings 442, 444 arranged in longitudinal relation relative to each other for allowing or permitting material in the hopper 12 to be rapidly and gravitationally discharged in a controlled manner therefrom. Suitable hood structure (not shown) similar to that discussed above, is used to operably separate the discharge opening from each other. As described above, however, the number of discharge openings comprising each discharge area can be greater than two without detracting or departing from the novel spirit and scope of this invention disclosure. In the embodiment illustrated by way of example in FIG. 15, each opening defined by hopper 12 preferably has a generally rectangular marginal edge configuration.

According to this embodiment of the invention disclosure, an appropriately sized door assembly is arranged in operable combination with each discharge opening comprising the respective discharge area at the bottom of the walled enclosure 12. In the embodiment illustrated in FIG. 15, the discharge area at the bottom 30 of the walled enclosure 12 preferably has two gate assemblies 452 and 454 arranged in operable combination therewith. Preferably, the gate assemblies 452 and 454 are arranged to gravitationally deposit commodity or material between the rails 29, 29' (FIG. 1). Again, it should be appreciated, the number of discharge gates arranged in operable combination with each discharge area will be a function of the number of discharge openings associated with each discharge area on the hopper 12. In a preferred embodiment, the gate assemblies 452 and 454 are similar relative to each other.

With the arrangement illustrated for exemplary purposes in FIG. 15, and when mounted on car 10, the two gate assemblies 452 and 454 are disposed in substantially aligned relation longitudinally relative to each other. In the illustrated embodiment, the gate assemblies 452 and 454 each include a rigid frame 460 defining a generally rectangular discharge outlet 462 arranged in generally registry or material receiving relation with one of the discharge openings partially comprising one of the discharge areas on car 10. Suffice it to say, the frame 460 of each gate assembly is similar to that described above regarding frame 60.

Each gate assembly 452 and 454 furthermore includes a slide door 470 mounted on the respective frame for movement preferably in a generally horizontal path of travel. Notably, in the embodiment illustrated in FIG. 15, the slide door 270 of each gate assembly moves in a direction extending generally parallel to the longitudinal axis 14 of the car 10.

In the example shown in FIG. 15, gate assembly 452 includes a suitable drive apparatus 474 for positively moving the slide door thereof anywhere between and to the first or closed position and the second or open position and relative to the discharge outlet of the respective gate assembly. In one form, drive apparatus 474 is substantially similar to the apparatus 74 described above. In the illustrated embodiment, the drive apparatus 474 for gate assembly 452 includes an elongated drive shaft assembly 475 including an elongated drive shaft 476 mounted on the frame of gate assembly 452 and extends generally normal to the axis 14 of car 10.

In the embodiment illustrated in FIG. 15, the drive apparatus 474 associated with gate assembly 452 for moving the slide door 470 thereof furthermore includes a mechanism for converting rotational movements of the drive shaft assembly 475 into linear movements of the slide door 470. In one form, such mechanism includes a conventional rack and pinion assembly 477 similar to assembly 77 described above. It will be appreciated, however, other devices and/or mechanisms can be used for converting rotational movements of the drive shaft assembly 475 into linear movements of the slide door 470 of gate assembly 452 without detracting or departing from broad spirit and scope of this invention disclosure.

To facilitate access thereto, at least one end of the drive apparatus 474 extends adjacent to one lateral side of the hopper railcar 10. In a preferred embodiment, and so as to facilitate operation of apparatus 474 from either side of car 10, opposed ends of apparatus 474 are disposed for access to opposed lateral sides of hopper car 10. Moreover, opposite ends of apparatus 474 are configured to promote rotation of apparatus 474 in either direction.

In the embodiment illustrated in FIG. 15, the slide door 470 of gate assembly 452 is operably coupled to the slide door 470 of gate assembly 454. In the embodiment illustrated by way of example in FIG. 15, apparatus 472 is used to operably interconnect the sliding doors of gate assemblies 452 and 454. In the illustrated embodiment, the design and configuration of apparatus 472 is such that it functions to operably pull the slide door 470 of the second gate assembly 454 from the closed position toward the open position in response to the slide door 470 of the first gate assembly 452 being pulled from the closed position toward the open position. In the illustrated embodiment, the design and configuration of apparatus 472 is such that it functions to operably push the slide door 270 of the second gate assembly 454 toward the closed position in response to movement of the slide gate 270 of the first gate assembly 452 being pushed toward the closed position. Suffice it to say, movements of the slide door slide door 470 of the first gate assembly 452 result in equivalent movements for the slide door 470 of the second gate assembly 454.

Preferably, the apparatus 472 for operably interconnecting the sliding doors of the gate assemblies 452 and 454 is substantially similar to apparatus 372 discussed above. It will be appreciated, however, other designs can be used to operably interconnect the sliding doors of the gate assemblies would equally suffice without detracting or seriously departing from the spirit and scope of this invention disclosure.

In operation, the slide door 470 of each gate assembly 452 and 454 is conjointly moved upon rotation of the drive apparatus 474 in an appropriate direction. That is, when the apparatus 474 is rotated, the slide door 470 of gate assembly 452 linearly moves. Because the slide gate 470 of gate assembly 452 is operably connected to the slide door 470 of gate assembly 454, positive rotation of the drive apparatus 474 effects simultaneous movements of the slide doors of both gate assemblies 452 and 454 in unison and relative to each other and relative to the respective discharge openings on the hopper whereby effecting rapid discharge of materials or commodity from the hopper 12.

The present invention disclosure further involves different but related methods for controlling the gravitational discharge of commodity from a railcar hopper car 10 having an elongated body 12 and an elongated axis 14. One methodology includes the steps of: configuring a bottom 30 of the elongated body 12 with a discharge area including multiple side-by-side discharge openings 42, 44, 46 and 48; with two 42, 44 of the openings preferably being arranged to one lateral side of the longitudinal axis 14 of the car 10 and the other openings 46, 48 being disposed on an opposite side of the axis 14 of car 10. Another step involves: arranging a gate assembly 52, 54, 56 and 58 in general registry with each discharge opening 42, 44, 46 and 48 to control the gravitational discharge of commodity from the car 10. Each gate assembly includes a slide door 70 movable anywhere between and to closed and open positions relative to the respective discharge opening and a rotatable drive 74 operably coupled to the respective gate 70. Another step involves: using a single operating shaft assembly 102 having a fixed axis of rotation 104 to move the slide door of each gate assembly conjointly relative to each other between closed and open positions.

Preferably, the method for controlling discharge of commodity from the railcar hopper car 10 includes the further step of: arranging the rotational axis 104 of the operating shaft assembly 102 such that the axis 104 operably extends between the two gate assemblies mounted 56, and 58 to the common lateral side of the longitudinal axis 14 of the hopper car 10.

In one form, the method for controlling discharge of commodity from the railcar hopper car preferably includes the further step of: connecting the rotatable drives 74 of the two gate assemblies 52, 54 disposed to a common lateral side of the axis 14 of car 10 with a shaft 110 extending generally parallel to the axis 14 of car 10. In one embodiment, the method for controlling discharge of commodity from the railcar hopper car includes the further step of: providing a force transfer mechanism 130 for operably connecting the shaft 110 used to operably connect the rotatable drives 74 of the two gate assemblies 52, 54 disposed to a common lateral side of car to the single operating shaft assembly 102.

In one form, the method for controlling discharge of commodity from the railcar hopper car preferably includes the further step of: connecting the rotatable drives 74 of the two gate assemblies 56, 58 disposed to a common lateral side of the longitudinal axis 14 of the hopper car with a shaft 120 extending generally parallel to the axis 14 of the car 10. In one embodiment, the method for controlling discharge of commodity from the railcar hopper car includes the further step of: providing a force transfer mechanism 150 for operably connecting the shaft 120 used to operably connect the rotatable drives 74 of the two gate assemblies 56, 58 disposed to a common lateral side of car to the single operating shaft assembly 102.

In one embodiment, the method for controlling discharge of commodity from the railcar hopper car includes the further step of: providing a second force transfer mechanism 130 for operably connecting the shaft 110 used to connect the rotatable drive 74 of the gate assembly mounted to an opposite lateral side of car to the single operating shaft assembly 14. Since the first and second force transfer mechanisms 130 and 140, respectively, each operates in response to rotation of the single operating shaft assembly 102, it will be appreciated, rotation of the shaft assembly 102 about axis 104 will result in simultaneous linear movements of the slide door 70 of each gate assembly 52, 54, 56 and 58 between closed and open positions depending upon the directional rotation of the shaft assembly 102 about axis 104.

Another disclosed methodology includes the steps of: configuring a bottom 30 of the elongated body 12 with a discharge area including two discharge openings 42 and 46 disposed to opposed lateral sides of axis 14 of car 10. Another step involves: arranging a gate assembly 252 in general registry with the discharge opening 42 to control the gravitational discharge of commodity from car 10. Gate assembly 252 includes a slide door 270 movable along a generally horizontal path of travel and a drive apparatus 274 for positively moving the slide door of the gate assembly anywhere between and to closed and open positions relative to the respective discharge opening. According to this aspect of the invention disclosure, the drive apparatus 274 preferably includes a rotatable operating shaft assembly 275 and a mechanism 277 for converting rotation of the operating shaft assembly into linear movements of the door of gate assembly 252.

According to this aspect of the invention disclosure, the methodology includes the further step of: arranging another gate assembly 256 in general registry with the other discharge opening 46 to further control the gravitational discharge of commodity from the railcar. According to this aspect of the invention disclosure, gate assembly 256 includes a slide door 270 movable along a generally horizontal and linear path of travel.

According to this aspect of the invention disclosure, the methodology includes the further step of: interconnecting the slide door 270 of gate assembly 252 with the slide door 270 of gate assembly 256 such that linear movements of the door 270 of the first gate assembly 252 anywhere between the closed and open positions are effectively transferred to the door 270 of the gate assembly 256 and used to linearly and conjointly move the door 270 of gate assembly 256 relative to the door 270 of the first gate assembly 252.

Preferably, the method according to this aspect of the invention disclosure furthermore involves the step of: arranging the gate assemblies 252 and 256, respectively, such that the slide door 270 of each gate assembly 252, 256 moves in a direction extending generally normal to the longitudinal axis 14 of the car 10. According to this aspect of the invention disclosure, the step of arranging the gate assemblies 252, and 256, respectively, involves generally aligning the gate assemblies 252 and 256, respectively, laterally relative to each other.

Preferably, the mechanism 277 for converting rotation of the operating shaft assembly into linear movements of the slide door of the gate assembly 252 includes a rack and pinion assembly. The methodology according to this aspect of the invention disclosure furthermore includes the step of: using a single operating shaft 302 having a fixed rotational axis 304 to move the slide doors 270 of the gate assemblies 252 and 256, respectively, conjointly relative to each other anywhere between their closed and open positions. According to this aspect of the invention disclosure, the slide doors 270 of the gate assemblies 252 and 256, respectively, are interconnected with connectors 273 extending between and secured to each slide door 270. The connectors 273 are preferably configured as to not interfere with the gravitational flow of material from the first and second discharge openings.

The methodology according to this aspect of the invention disclosure includes the further step of: configuring the bottom of the elongated body with two additional discharge openings disposed to opposed lateral sides of the axis 14 of car 10. These additional discharge openings are generally laterally aligned relative to each other. The methodology according to this aspect of the invention disclosure includes the further step of: arranging another gate assembly 254 in general registry with one of the additional discharge opening 44 to control the gravitational discharge of commodity from the railcar. Gate assembly 254 includes a slide door 270 movable along a generally horizontal and linear path of travel and a drive apparatus 274 for positively moving the slide door 270 of gate assembly 254 anywhere between and to the closed position and the open position relative to the third discharge opening. According to this aspect, the drive apparatus 274 of gate assembly includes a rotatable operating shaft assembly 275, and a mechanism 277 for converting rotation of the operating shaft assembly into linear movements of the slide door of gate assembly 254.

According to this aspect, the methodology also involves: still another gate assembly 258 is arranged in general registry with the discharge opening 48 to further control the gravitational discharge of commodity from the railcar 10. According to this aspect, gate assembly 258 includes a slide door 270 movable along a generally horizontal and linear path of travel anywhere between and to closed and open positions relative to the discharge opening 48. Preferably, the gate assemblies 252 and 254 are generally aligned longitudinally relative to each other.

Another step involved with this aspect of the invention disclosure includes: interconnecting the slide door 270 of gate assembly 254 with the slide door of gate assembly 258 such that linear movements of the slide door 270 of gate assembly 254 are effectively transferred to the slide door 270 of gate assembly 258 and used to linearly and conjointly move the slide door 270 of gate assembly 258. Preferably, the slide doors 270 of gate assemblies 254 and 258 are interconnected with connectors extending between and secured to an underside of each door. In one form, the connectors are each configured as to not interfere with the gravitational flow of material from the respective discharge openings.

The methodology according to this aspect of the invention disclosure includes the further step of: using the single operating shaft assembly to move the slide doors 270 of the gate assemblies 252, 256, 254 and 258, respectively, conjointly relative to each other anywhere between their closed and open positions. According to this aspect of the invention disclosure, the methodology further includes the step of: arranging the rotational axis 304 of the single operating shaft assembly 302 such that the rotational axis 304 operably extends between the first and second gate assemblies 252 and 254, respectively, mounted to the common lateral side of the longitudinal axis 14 of car 10. Preferably, and according to this aspect of the invention disclosure, the methodology further includes the step of: connecting the drive apparatus 274 of the gate assemblies, 252 and 254, respectively, mounted to a common lateral side of the axis 14 of car 10 with a shaft 310 extending generally parallel to the axis 14 of car 10.

Another disclosed methodology for controlling the gravitational discharge of commodity from a railroad hopper car having an elongated car body defining an elongated axis with opposed lateral sides involves the steps of: configuring a bottom 30 of the car body 12 with first and second discharge openings 442 and 444, respectively. The method further includes the step of arranging a first gate assembly 452 in general registry with the first discharge opening 442 to control the gravitational discharge of commodity from the railcar. The first gate assembly 452 includes a slide door 470 movable along a generally horizontal and linear path of travel. The first gate assembly 452 also includes a drive apparatus 474 for positively moving the slide door 470 of the first gate assembly 452 anywhere between closed and open positions relative to the first discharge opening 442. The drive apparatus 474 of the first gate assembly 452 includes a rotatable operating shaft assembly 476 and a mechanism 477 for converting rotation of the operating shaft assembly 476 into linear movements of the slide door 470 of the first gate assembly 452.

According to this aspect of the invention disclosure, the method also includes the step of: arranging a second gate assembly 454 in general registry with the second discharge opening 444 to further control the gravitational discharge of commodity from the railcar. The second gate assembly 454 includes a slide door 470 movable along a generally horizontal and linear path of travel. The method also includes the step of: interconnecting the slide door 470 of the first gate assembly 452 with the slide door 470 of the second gate assembly 454 such that linear movements of the door 470 of the first gate assembly 452 anywhere between the closed and open positions are effectively transferred to the door 470 of the second gate assembly 454 and used to linearly and conjointly move the door 470 of the second gate assembly 454.

Preferably, the method according to this aspect of the invention disclosure furthermore involves the step of: arranging the first and second gate assemblies 452 and 454, respectively, in generally aligned relation longitudinally relative to each other. According to this aspect of the invention disclosure, the mechanism 477 for converting rotation of the operating shaft assembly into linear movements of the slide door 470 of the first agate assembly 452 preferably includes a rack and pinion assembly. In a preferred form, the first and second gate assemblies 452 and 454, respectively, are interconnected with a series of laterally spaced connectors 473 extending between and secured to the slide door 470 of each gate assembly 452 and 454. The connectors 473 are arranged in generally parallel relation relative to the axis 14 of car 10. Each connector 473 is preferably configured as to not interfere with the gravitational flow of material from the first and second discharge openings 442 and 44, respectively. In a preferred form, a length of each connector 473 extends at least partially under and is suitably secured to an underside 471 of each slide gate 470. It will be appreciated, other designs for operably interconnecting the sliding doors of the gate assemblies will equally suffice without detracting or seriously departing from the spirit and scope of this invention disclosure.

From the forgoing, it will be observed numerous modifications and variations can be made and effected without departing or detracting from the true spirit and novel concept of this invention disclosure. Moreover, it will be appreciated, the present disclosure is intended to set forth exemplifications which are not intended to limit the disclosure to the specific embodiments illustrated and discussed. Rather, this disclosure is intended to cover by the appended claims all such modifications and variations as fall within the spirit and scope of the claims.

What is claimed is:

1. A hopper railcar having a longitudinal axis, a hopper for receiving and holding materials, with said hopper being mounted on a frame, said railcar comprising:

at least three gate assemblies, with one gate assembly being individually arranged in material receiving relation relative to one of a series of openings on said hopper, with two of the gate assemblies being longitudinally aligned relative to each other and disposed to one lateral side of the longitudinal axis of the hopper railcar and with a third gate assembly being disposed to an opposite lateral side of the longitudinal axis of said hopper, with each individual gate assembly having a frame including two side frame members rigidly interconnected to two end frame members, with the side frame members and end frame members of each gate assembly being configured toward their upper end with a mounting flange to facilitate individualized mounting of said gate assembly to the hopper, with the end frame members and side frame members of each gate assembly defining therebetween a discharge outlet arranged in material receiving relation relative to an opening defined by the hopper on the railcar, with each individual gate assembly further including a slide door mounted between the side frame members and end frame members for sliding movement in a direction extending generally normal to the longitudinal axis of said car, and with each gate assembly also including a drive mechanism disposed adjacent one end of said gate assembly frame, a drive apparatus for slidably moving the slide door of each gate assembly anywhere between open and closed positions relative to the respective discharge opening of the respective gate assembly, with said drive apparatus comprising:

an operating shaft assembly mounted for rotation about a fixed axis, with the fixed axis of said operating shaft assembly extending generally normal to the longitudinal axis of said hopper railcar, and with at least one end of said operating shaft assembly extending adjacent to one lateral side of the hopper railcar and such that rotation of said operating shaft assembly about the fixed axis thereof forcibly and conjointly moves the slide door of each gate assembly between positions as a function of the direction of rotation of said operating shaft;

a first drive shaft extending generally parallel to the longitudinal axis of said railcar and operably coupled to the drive apparatus of each of the two gate assemblies mounted to one lateral side of the longitudinal axis of the hopper railcar;

a second drive shaft extending generally parallel to the longitudinal axis of said railcar and operably coupled to the drive apparatus of the third gate assembly mounted to a lateral side of the longitudinal axis of the hopper railcar opposite from at least one of the other two gate assemblies;

a first force transfer mechanism operably connected between said operating shaft assembly and said first drive shaft; and a second force transfer mechanism operably connected between said operating shaft assembly and said second drive shaft.

2. The hopper railcar according to claim 1, wherein each force transfer mechanism includes a gear box having an input gear and an output gear arranged in intermeshing relationship relative to each other.

3. The hopper railcar according to claim 2, wherein the input gear and output gears of each gear box have a ratio of about 5:1 therebetween.

4. The hopper railcar according to claim 1, wherein said operating shaft assembly extends between said two longitudinally aligned gate assemblies.

5. The hopper railcar according to claim 1, wherein said operating shaft assembly includes an elongated operating shaft, with at least one end of end of said operating shaft extending adjacent to one lateral side of the hopper railcar.

6. The hopper railcar according to claim wherein the drive mechanism of each gate assembly includes a rack and pinion assembly with a pair of racks provided on each sliding gate and a pair of pinion gears arranged in intermeshing relationship with said racks, with said pinion gears being arranged on a shaft which is supported by the frame of each gate assembly for rotational movement about a fixed axis.

7. The hopper railcar according to claim wherein the operating shaft assembly of said drive apparatus for slidably moving the door of each of said gate assemblies is operably connected to the sliding doors of those gate assemblies arranged to one lateral side of the longitudinal axis of said car body by a first force transfer mechanism, and with the single operating shaft assembly of said mechanism for simultaneously moving each of said sliding doors is operably connected to the sliding door arranged to an opposed lateral side of the longitudinal axis of said car body by a second force transfer mechanism such that that rotation of said operating shaft assembly about the fixed axis thereof forcibly and conjointly moves all the sliding doors conjointly between positions as a function of the direction of rotation of said operating shaft assembly.

8. The hopper railcar according to claim 1, wherein each force transfer mechanism includes a gear box having an input gear and an output gear arranged in intermeshing relationship relative to each other.

9. The hopper railcar according to claim 8, wherein the input gear and output gears of each gear box have a ratio of about 5:1 therebetween.

10. A hopper railcar having a longitudinal axis, said hopper car comprising:

four individual gate assemblies mounted to said hopper railcar, with each individual gate assembly being operably associated with one of a series of openings forming part of an enlarged discharge area defined toward a bottom of the hopper railcar, with first and second gate assemblies being generally longitudinally aligned relative to each other and disposed to one lateral side of the longitudinal axis of the hopper railcar, and with third and fourth gate assemblies being generally longitudinally aligned relative to each other on a second lateral side of the longitudinal axis of said hopper railcar, and with said first and third gate assemblies and said second and fourth gate assemblies, respectively, being generally laterally aligned relative to each other, with each individual gate assembly having a frame including two side frame members rigidly joined to two end frame members, with the side frame members and end frame members of each gate assembly being configured toward their upper end with a mounting flange to facilitate individualized mounting of said gate assembly to the railcar, with the frame members of each individual gate assembly defining a discharge outlet arranged in material receiving relation relative to one of said openings defined by a hopper on said railcar, with each individual gate assembly further including a slide door mounted on the slide frame of each gate assembly for movements in a direction extending generally normal to the longitudinal axis of said car, and with the first and second longitudinally aligned gate assemblies mounted to the one lateral side of the longitudinal axis of the hopper railcar each including a drive apparatus for moving the respective slide of said first and second gate assemblies anywhere between open and closed positions relative to the respective discharge opening of the respective gate assembly a mechanism for conjointly controlling operation of the four individual gate assemblies, with said mechanism comprising:

an operating shaft assembly mounted for rotation about a fixed axis, with the fixed axis of said operating shaft assembly extending generally normal to the longitudinal axis of said hopper railcar, and with at least one end of said operating shaft assembly extending adjacent to one lateral side of the hopper railcar;

a drive shaft extending generally parallel to the longitudinal axis of said railcar and operably coupled to the drive apparatus of each of the first and second gate assemblies mounted to one lateral side of the longitudinal axis of the hopper railcar;

a force transfer mechanism operably connected between said operating shaft assembly and said drive shaft; and with the slide doors of the third and fourth gate assemblies being operably coupled to the slide doors of said first and second gates assemblies, respectively, such that rotation of said operating shaft assembly about the fixed axis thereof forcibly and conjointly moves the slide door of each gate assembly anywhere between and to the closed and open positions as a function of the direction of rotation of said operating shaft.

11. The hopper railcar according to claim 10, wherein the force transfer mechanism of said mechanism for conjointly controlling operation of the four individual gate assemblies includes a gear box having an input gear and an output gear arranged in intermeshing relationship relative to each other.

12. The hopper railcar according to claim 11, wherein the input gear and output gears of each gear box of the force transfer mechanism have a ratio of about 5:1 therebetween.

13. The a hopper railcar according to claim 10, wherein said operating shaft assembly of said mechanism for conjointly controlling operation of the four individual gate assemblies extends between said first and second generally longitudinally aligned gate assemblies.

14. A mechanism for conjointly controlling first and second generally aligned gate assemblies adapted to be mounted to a hopper railcar having a longitudinal axis, with each gate assembly being adapted to be operably associated with first and second openings defined toward a bottom of the hopper railcar, with each gate assembly having a frame defining a discharge outlet and a door mounted on the respective frame of each gate assembly for generally horizontal sliding movements, said mechanism comprising:

a drive apparatus arranged in operable combination with said first gate assembly for positively moving the slide door of said first gate assembly anywhere between and to a closed position and an open position relative to the discharge outlet of the first gate assembly, said drive apparatus including an operating shaft assembly mounted on the frame of said first gate assembly for rotation about a fixed axis, and a mechanism for converting rotation of said operating shaft assembly into linear sliding movements of the door of said first agate assembly; and an apparatus for operably interconnecting the sliding door of said first gate assembly with the sliding door of the second gate assembly such that linear movements of the door of said first gate assembly anywhere between the closed and open positions is effectively transferred to the door of the second gate assembly and used to linearly and conjointly move the sliding door of the second gate assembly between closed and open positions, and wherein said apparatus for operably interconnecting the slide door of said first gate assembly with the slide door of the second gate assembly includes a series of spaced connectors extending from the slide door of said first gate assembly to the slide door of said second gate assembly, with spacing between said connectors permitting substantially uninterrupted passage of material thereover.

15. The mechanism according to claim 14, wherein the fixed axis of the operating shaft assembly of the drive apparatus arranged in operable combination with said first gate assembly extends generally parallel with the longitudinal axis of said hopper railcar.

16. The mechanism according to claim 14, wherein the operating shaft assembly of said drive apparatus arranged in operable combination with said first gate assembly includes an elongated operating shaft mounted for rotation about the fixed axis of said operating shaft assembly, and wherein said drive apparatus further includes a rack and pinion assembly.

17. The mechanism according to claim 14, wherein the connectors of said apparatus for operably interconnecting the slide door of said first gate assembly with the slide door of the second gate assembly are arranged in generally normal relation relative to the longitudinal axis of said hopper railcar.

18. The mechanism according to claim 14, wherein said apparatus for operably interconnecting the slide door of said first gate assembly with the slide door of the second gate assembly functions to operably push the slide door of the second gate assembly from the closed position toward the open position in response to movement of the slide door of the first gate assembly from the closed position toward the open position.

19. A method for controlling the gravitational discharge of commodity from a railcar hopper car having an elongated body defining a longitudinal axis, with said elongated body having opposed lateral sides along with a bottom defining a discharge area including at least three discharge openings, with two of said discharge openings being arranged to one lateral side of the longitudinal axis and a third discharge opening being arranged to an opposite side of the longitudinal axis, said method comprising the steps of:

mounting a gate assembly individually and in general registry with each of said discharge openings to control the gravitational discharge of commodity from said car and such that two gate assemblies are individually mounted to said car and to a common lateral side of the longitudinal axis of said car while another gate assembly is individually mounted to said car on an opposite lateral side of the longitudinal axis of said car, with each gate assembly including two side frame members rigidly interconnected to two end frame members, with the side frame members and end frame members of each gate assembly being configured toward their upper end with a mounting flange to facilitate individualized mounting of said gate assembly to the elongated body of said railcar, with the end frame members and side frame members of each gate assembly defining therebetween a discharge outlet arranged in material receiving relation relative to one of said discharge opening defined by the bottom of said elongated body on said railcar, with each gate assembly further including a slide door mounted between the side frame members and end frame members of each gate assembly for sliding movement in a direction extending generally normal to the elongated axis of said hopper car between closed and open position relative to the respective discharge opening, and a rotatable drive operably coupled to the respective slide door for moving the respective slide door anywhere between and to the closed and open positions; and using a single operating shaft assembly having a fixed axis of rotation to move the slide doors of each gate assembly conjointly relative to each other anywhere between and to said closed and open positions so as to facilitate discharge of materials from said railcar through said discharge area.

20. The method for controlling discharge of commodity from a railcar hopper car according to claim 19, including the further step of:

arranging the rotational axis of said single operating shaft assembly such that said rotational axis operably extends between the two gate assemblies mounted to the common lateral side of the longitudinal axis of said hopper car.

21. The method for controlling discharge of commodity from a railcar hopper car according to claim 19, including the further step of:

connecting the rotatable drive of the two gate assemblies mounted to a common lateral side of the longitudinal axis of said hopper car with a shaft extending generally parallel to the longitudinal axis of said hopper car.

22. The method for controlling discharge of commodity from a railcar hopper car according to claim 19, including the further step of:

providing a first force transfer mechanism for operably connecting the rotatable drive of the two gate assemblies mounted to one common lateral side of the longitudinal axis of said hopper car to said single operating shaft assembly.

23. The method for controlling discharge of commodity from a railcar hopper car according to claim 22, including the further step of:

providing a second force transfer mechanism for operably connecting the rotatable drive shaft of the gate assembly mounted to an opposed lateral side of the longitudinal axis of said hopper car to said single operating shaft assembly.

24. A method for controlling the gravitational discharge of commodity from a railroad hopper car having an elongated body defining an elongated axis, with said elongated body having opposed lateral sides along with a bottom defining first and second aligned discharge openings, said method comprising the steps of:

arranging a first gate assembly in general registry with said first discharge opening to control the gravitational discharge of commodity from said car, with said first gate assembly including a slide door movable along a generally horizontal and linear path of travel between closed and open position relative to the first discharge opening, a drive apparatus for positively moving the slide door of said first gate assembly between the closed position and the open position relative to the first discharge opening, with said drive apparatus including a rotatable operating shaft assembly, and a mechanism for converting rotation of said operating shaft assembly into linear movements of the gate of said first agate assembly;

arranging a second gate assembly in general registry with said second discharge opening to further control the gravitational discharge of commodity from said car, with said second gate assembly including a slide door movable along a generally horizontal and linear path of travel between closed and open position relative to the second discharge opening, and interconnecting the slide door of said first gate assembly with the slide door of said second gate assembly with a series of spaced connectors secured to the slide doors of said first and second gate assemblies, with spacing between said connectors permitting substantially uninterrupted passage of material thereover such that linear movements of the door of said first gate assembly between the closed and open positions are effectively transferred to the door of the second gate assembly and used to linearly and conjointly move the door of the second gate assembly between closed and open positions.

25. The method according to claim 24, wherein the step of arranging the first and second gate assemblies involves generally aligning said first and second gate assemblies longitudinally relative to each other.

26. The method according to claim 24, wherein the mechanism for converting rotation of said operating shaft assembly into linear movements of the gate of said first agate assembly includes a rack and pinion assembly.

27. A method for controlling the gravitational discharge of commodity from a railroad hopper car having an elongated body having opposed lateral sides and defining an elongated axis, with said elongated body having opposed lateral sides along with a bottom defining first and second laterally spaced discharge openings disposed to opposed lateral sides of the elongated axis of said railroad hopper car, said method comprising the steps of:

arranging a first gate assembly in general registry with said first discharge opening to control the gravitational discharge of commodity from said car, with said first gate assembly including a slide door movable along a generally horizontal and linear path of travel between closed and open position relative to the first discharge opening, a drive apparatus for positively moving the slide door of said first gate assembly between the closed position and the open position relative to the first discharge opening, with said drive apparatus including a rotatable operating shaft assembly, and a mechanism for converting rotation of said operating shaft assembly into linear movements of the slide door of said first agate assembly;

arranging a second gate assembly in general registry with said second discharge opening to further control the gravitational discharge of commodity from said car, with said second gate assembly including a slide door movable along a generally horizontal and linear path of travel between closed and open position relative to the second discharge opening, and interconnecting the slide door of said first gate assembly with the slide door of said second gate assembly with a series of spaced connectors secured to an underside of the slide doors of said first and second gate assemblies, with spacing between said connectors permitting substantially uninterrupted passage of material thereover such that linear movements of the door of said first gate assembly between the closed and open positions are effectively transferred to the door of the second gate assembly and used to linearly and conjointly move both doors of the first and second gate assemblies between closed and open positions.

28. The method according to claim 27, further including the step of:

arranging said first and second gate assemblies such that the slide door of each gate assembly moves in a direction extending generally normal to the longitudinal axis of said railroad hopper car.

29. The method according to claim 27, wherein the steps of arranging the first and second gate assemblies involves generally aligning said first and second gate assemblies laterally relative to each other.

30. The method according to claim 27, including the further step of:

using a single operating shaft assembly having a fixed axis of rotation to move the slide doors of the first and second gate assemblies conjointly relative to each other between said closed and open positions.

31. The method according to claim 27, wherein the bottom of the elongated body further defines third and fourth discharge openings disposed to opposed lateral side of the elongated axis of the railroad hopper car, with said method further including the steps of:

providing third and fourth gate assemblies in generally laterally aligned relative to each other;

arranging the third gate assembly in general registry with the third discharge opening on said car to control the gravitational discharge of commodity from the car, with the third gate assembly including a slide door movable along a generally horizontal and linear path of travel anywhere between a closed and an open position relative to the third discharge opening;

providing a drive apparatus for positively moving the slide door of the third gate assembly anywhere between the closed position and the open position relative to the third discharge opening, with the drive apparatus including a rotatable operating shaft assembly, and a mechanism for converting rotation of the operating shaft assembly into linear movements of the slide door of the third agate assembly;

arranging the fourth gate assembly in general registry with the fourth discharge opening on said car to further control the gravitational discharge of commodity from the car, with the fourth gate assembly including a slide door movable along a generally horizontal and linear path of travel anywhere between a closed and an open positions relative to the fourth discharge opening, and interconnecting the slide door of the third gate assembly with the slide door of the fourth gate assembly with a series of spaced connectors secured to the slide doors of said first and second gate assemblies, with spacing between said connectors permitting substantially uninterrupted passage of material thereover such that linear movements of the slide door of the third gate assembly between the closed and open positions are effectively transferred to the slide door of the fourth gate assembly and used to linearly and conjointly move the slide door of the fourth gate assembly with the slide door of the third gate assembly between closed and open positions.

32. The method according to claim 31, including the further steps of:

arranging the third gate assembly in general longitudinal alignment with the first gate assembly; and arranging the fourth gate assembly in general longitudinal alignment with the second gate assembly.

* * * * *